US007330812B2

(12) United States Patent
Ding

(10) Patent No.: US 7,330,812 B2
(45) Date of Patent: Feb. 12, 2008

(54) METHOD AND APPARATUS FOR TRANSMITTING AN AUDIO STREAM HAVING ADDITIONAL PAYLOAD IN A HIDDEN SUB-CHANNEL

(75) Inventor: Heping Ding, Ottawa (CA)

(73) Assignee: National Research Council of Canada, Ottawa, Ontario (CA)

( * ) Notice: Subject to any disclaimer, the term of this patent is extended or adjusted under 35 U.S.C. 154(b) by 931 days.

(21) Appl. No.: 10/658,406

(22) Filed: Sep. 10, 2003

(65) Prior Publication Data

US 2004/0068399 A1 Apr. 8, 2004

Related U.S. Application Data

(60) Provisional application No. 60/415,766, filed on Oct. 4, 2002.

(51) Int. Cl.
*G10L 19/02* (2006.01)

(52) U.S. Cl. ..... 704/200.1; 704/229; 704/201; 704/500; 370/392; 370/352

(58) Field of Classification Search ..... 704/219, 704/229, 200.1, 201, 500–504; 370/392, 370/352, 389, 516, 261
See application file for complete search history.

(56) References Cited

U.S. PATENT DOCUMENTS 4,757,495 A 7/1988 Decker et al.
5,451,954 A * 9/1995 Davis et al. ..... 341/200
5,727,119 A * 3/1998 Davidson et al. ..... 704/203
6,124,895 A * 9/2000 Fielder ..... 348/515
6,226,608 B1 * 5/2001 Fielder et al. ..... 704/229

OTHER PUBLICATIONS

Kim et al., ("A New Bandwidth scalable wideband speech/audio coder", Proceedings of IEEE International Conference on Acoustics, Speech, and Signal Processing, Orlando, FL, U.S.A., May 13-17, 2002, pp. 657-660).*
John F. Tilki, A. A. Beex, "Encoding a Hidden Digital Signature onto an Audio Signal Using Psychoacoustic Masking," *Proceedings of the 7th International Conference on Signal Processing Applications and Technology*, pp. 476-480, Boston, MA, U. S. A., Oct. 7-10, 1996.

(Continued)

*Primary Examiner*—Vijay Chawan
(74) *Attorney, Agent, or Firm*—Curtis B. Behmann; Borden Ladner Gervais LLP

(57) ABSTRACT

Methods and apparatus are provided for communicating an audio stream. A perceptual mask is estimated for an audio stream, based on the perceptual threshold of the human auditory system. A hidden sub-channel is dynamically allocated substantially below the estimated perceptual mask based on the characteristics of the audio stream, in which additional payload is transmitted. The additional payload can be related to components of the audio stream that would not otherwise be transmitted in a narrowband signal, or to concurrent services that can be accessed while the audio stream is being transmitted. A suitable receiver can recover the additional payload, whereas the audio stream will be virtually unaffected from a human auditory standpoint when received by a traditional receiver. A coding scheme is also provided in which a portion of a codec is used to code an upper-band portion of an audio stream, while the narrowband portion is left uncoded.

22 Claims, 14 Drawing Sheets

OTHER PUBLICATIONS

Ted Painter, Andreas Spanias, "Perceptual Coding of Digital Audio," *Proceedings of the IEEE*, vol. 88, No. 4, pp. 451-513, Apr. 2000.

International Telecommunication Union, "7 kHz Audio—Coding With 64 KBITS/S," ITU-T Receommendation G.722, 1993.

Michael A. Gerzon, Peter G. Craven, "A High-Rate Buried Channel for Audio CD," J. Audio Eng. Soc., vol. 43, No. 1/2, pp. 3-22, Jan./Feb. 1995.

A. W.J. Oomen, M. E. Groenewegen, R. G. Van Der Waal, R. N. J. Veldhuis, "A variable-Bit-Rate Buried-Data Channel for Compact Disc," J. Audio Eng. Soc., vol. 43, No. 1/2, pp. 23-28, Jan./Feb. 1995.

International Telecommunication Union, "Coding of Speech at 8 kbits/s Using Conjugate-Structure Algebraic-Code-Excited Linear-Prediction (CS-ACELP)," ITU-T Recommendation G.729, Mar. 1996.

Heping Ding, Chongzhi Yu, "Adaptive Lattice Noise Canceller and Optimal Stop Size," *Proceedings of IEEE International Conference on Acoustics, Speech, and Signal Processing*, pp. 2939-2942, Tokyo, Japan, Apr. 1986.

Mitsuhiro Hosoki, Takayuki Nagai, Akira Kurematsu, "Speech Signal Band Width Extension and Noise Removal Using Voicing GMM Interpolation and HNM," *Proceedings of IEEE International Conference on Acoustics, Speech, and Signal Processing*, Orlando FL, U. S. A., May 13-17, 2002.

Dar Ghulam Raza, Cheung-Fat Chan, Enhancing Quality of CELP Coded Speech via Wideband Extension by Using Voicing GMM Interpolation and HNM Re-Synthe-sis, *Proceedings of IEEE International Conference on Acoustics, Speech, and Signal Processing*, Orlando, FL, U. S. A., May 13-17, 2002.

Hui Dong, Jerry Gibson, "Bandwidth Scalable Speech Coding and Rate Switching," *Proceedings of IEEE International Conference on Acoustics, Speech, and Signal Processing*, Orlando, FL, U. S. A., May 13-17, 2002.

Kyung Tae Kim, Sung Kyo Jung, Young Cheol Park, Dae Hee Youn, "A New Band-width-Scalable Wideband Speech/Audio Coder," *Proceedings of IEEE International Conference on Acoustics, Speech, and Signal Processing*, Orlando, FL, U. S. A., May 13-17, 2002.

* cited by examiner

METHOD AND APPARATUS FOR TRANSMITTING AN AUDIO STREAM HAVING ADDITIONAL PAYLOAD IN A HIDDEN SUB-CHANNEL

CROSS-REFERENCE TO RELATED APPLICATIONS

This application claims the benefit of priority from U.S. patent application Ser. No. 60/415,766, filed on Oct. 4, 2002.

FIELD OF THE INVENTION

The present invention relates generally to increasing the information carrying capacity of an audio signal. More particularly, the present invention relates to increasing the information carrying capacity of audio communications signals by transmitting an audio stream having additional payload in a hidden sub-channel.

BACKGROUND OF THE INVENTION

The standard public switched telephone network (PSTN), which has been part of our daily life for more than a century, is designed to transmit toll-quality voice only. This design target has been inherited in most modern and fully digitized phone systems, such as digital private branch exchange (PBX) and voice over IP (VoIP) phones. As a result, these systems, i.e., the PSTN (whether implemented digitally or in analog circuitry), digital PBX, and VoIP, are only able to deliver analog signals in a relatively narrow frequency band, about 200-3500 Hz, as illustrated in FIG. 1. This bandwidth will be referred to herein as "narrow band" (NB).

An NB bandwidth is so small that the intelligibility of speech suffers frequently, not to mention the poor subjective quality of the audio. Moreover, with the entire bandwidth occupied and used up by voice, there is little room left for additional payload that can support other services and features. In order to improve the voice quality and intelligibility and/or to incorporate additional services and features, a larger frequency bandwidth is needed.

Over the past several decades, the PSTN has evolved from analog to digital, with many performance indices, such as switching and control, greatly improved. In addition, there are emerging fully digitized systems like digital PBX and VoIP. However, the bandwidth design target for the equipment of these systems, i.e., narrow band (NB) for transmitting toll-quality voice only, has not changed at all. Thus, the existing infrastructure, either PSTN, digital PBX, or VoIP, cannot be relied upon to provide a wider frequency band. Alternate solutions have to be investigated.

Many efforts have been made to extend the capacity of an NB channel given the limited physical bandwidth. Existing approaches, which will be described below, can be classified into the following categories: time or frequency division multiplexing; voice or audio encoding; simultaneous voice and data; and audio watermarking.

Time or frequency division multiplexing techniques are simple in that they place voice and the additional payload in regions that are different in time or frequency. For example in the well known calling line ID (CLID) display feature, which is now widely used in telephone services, information about the caller's identity is sent to the called party's terminal between the first and the second rings, a period in which there is no other signal on line. This information is then decoded and the caller's identity displayed on the called terminal. Another example is the call waiting feature in telephony, which provides an audible beep to a person while talking on line as an indication that a third party is trying to reach him/her. This beep replaces the voice the first party might be hearing, and thus can cause a voice interruption. These two examples are time-division multiplexing approaches. A typical terminal product that incorporates these features is Vista 390™, by Aastra Technologies Limited.

As a frequency-division multiplexing example, frequency components of voice can be limited to below 2 kHz and the band beyond that frequency can be used to transmit the additional payload. This frequency limiting operation further degrades the already-low voice quality and intelligibility associated with an NB channel. Another frequency-division multiplexing example makes use of both lower and upper frequency bands that are just beyond voice but still within the PSTN's capacity, although these bands may be narrow or even non-existent sometimes. With some built-in intelligence, the system first performs an initial testing of the channel condition then uses the result, together with a pre-stored user-selectable preference, to determine a trade-off between voice quality and rate of additional payload. Time and frequency division multiplexing approaches are simple and therefore are widely used. They inevitably cause voice interruption or degradation, or both.

Voice coding and decoding (vocoding) schemes have been developed with the advancement of the studies on speech production mechanisms and psycho-acoustics, as well as of the rapid development of digital signal processing (DSP) theory and technology. A traditional depiction of, the frequencies employed in narrowband telephony, such as using standard PSTN, digital PBX or VoIP, is shown in FIG. 1. Wide band (WB) telephony extends the frequency band of the NB telephony to 50 Hz and 7000 Hz at the low and high ends, respectively, providing a much better intelligibility and voice quality. Since the WB telephony cannot be implemented directly on an NB telephone network, compression schemes, such as ITU standards G.722, G.722.1, and G.722.2, have been developed to reduce the digital bit rate (number of digital bits needed per unit of time) to a level that is the same as, or lower than, that needed for transmitting NB voice. Other examples are audio coding schemes MPEG-1 and MPEG-2 that are based on a human perceptual model. They effectively reduce the bit rate as do the G.722, G.722.1, and G.722.2 WB vocoders, but with better performance, more flexibility, and more complexity.

All existing voice and audio coding, or compression, schemes operate in a digital domain, i.e., a coder at the transmitting end outputs digital bits, which a decoder at the receiving end inputs. Therefore with the PSTN case, a modulator/demodulator (modem) at each end of the connection is required in order to transmit and receive the digital bits over the analog channel. This modem is sometimes referred to as a "channel coding/decoding" device, because it convert between digital bits and proper waveforms on line. Thus to implement a voice/audio coding scheme on a PSTN system, one will need an implementation of the chosen voice/audio coding scheme, either hardware or firmware, and a modem device if used with a PSTN. Such an implementation can be quite complicated. Furthermore, it is not compatible with the existing terminal equipment in the PSTN case. That is, a conventional NB phone, denoted as a "plain ordinary telephone set" (POTS), is not able to communicate with such an implementation on the PSTN line because it is equipped with neither a voice/audio coding scheme nor a modem.

Another category of PSTN capacity extension schemes is called "simultaneous voice and data" (SVD), and is often used in dial-up modems that connect computers to the Internet through the PSTN.

In an example, the additional payload, i.e., data in the context of SVD, is modulated by a carrier to yield a signal with a very narrow band, around 2500 Hz. This is then mixed with the voice. The receiver uses a mechanism similar to an adaptive "decision feedback equalizer" (DFE) in data communications to recover the data and to subtract the carrier from the composite signal in order for the listener not to be annoyed. This technique depends on a properly converged DFE to arrive at a low bit error rate (BER), and a user with a POTS, which does not have a DFE to remove the carrier, will certainly be annoyed by the modulated data, since it is right in the voice band.

In a typical example of SVD, each symbol (unit of data transmission) of data is phase-shift keyed (PSK) so that it takes one of several discrete points in a two-dimensional symbol constellation diagram. The analog voice signal, with a peak magnitude limited to less than half the distance separating the symbols, is then added so that the combined signal consists of clouds, as opposed to dots, in the symbol constellation diagram. At the receiver, each data symbol is determined based on which discrete point in the constellation diagram it is closest to. The symbol is then subtracted from the combined signal in an attempt to recover the voice. This method reduces the dynamic range, hence the signal-to-noise ratio (SNR), of voice. Again, a terminal without an SVD-capable modem, such as POTS, cannot access the voice portion gracefully. To summarize, SVD approaches generally need SVD-capable modem hardware, which can be complicated and costly, and are not compatible with the conventional end-user equipment, e.g., a POTS.

Audio watermarking techniques are based on the concept of audio watermarking, in the context of embedding certain information in an audio stream in ways so that it is inaudible to the human ear. A most common category of audio watermarking techniques uses the concept of spread spectrum communications. Spread spectrum technology can be employed to turn the additional payload into a low level, noise-like, time sequence. The characteristics of the human auditory system (HAS) can also be used. The temporal and frequency masking thresholds, calculated by using the methods specified in MPEG audio coding standards, are used to shape the embedded sequence. Audio watermarking techniques based on spread spectrum technology are in general vulnerable to channel degradations such as filtering, and the amount of payload has to be very low (in the order of 20 bits per second of audio) in order for them to be acceptably robust.

Other audio watermarking techniques include: frequency division multiplexing, as discussed earlier; the use of phases of the signal's frequency components to bear the additional payload, since human ears are insensitive to absolute phase values; and embedding the additional payload as echoes of the original signal. Audio watermarking techniques are generally aimed at high security, i.e., low probability of being detected or removed by a potential attacker, and low payload rate. Furthermore, a drawback of most audio watermarking algorithms is that they experience a large processing latency. The preferred requirements for extending the NB capacity are just the opposite, namely a desire for a high payload rate and a short detection time. Security is considered less of an issue because the PSTN, digital PBX, or VoIP is not generally considered as a secured communications system.

It is, therefore, desirable to provide a scheme which can be easily implemented using current technology and which extends the capacity of an NB channel at a higher data rate than that which is achievable using conventional techniques.

SUMMARY OF THE INVENTION

It is an object of the present invention to obviate or mitigate at least one disadvantage of previous schemes or arrangements for transmitting and/or receiving audio streams.

In a first aspect, the present invention provides a method of transmitting an audio stream. The method includes the following steps: estimating a perceptual mask or the audio stream, the perceptual mask being based on a human auditory system perceptual threshold; dynamically allocating a hidden sub-channel substantially below the estimated perceptual mask for the audio stream, the dynamic allocation being based on characteristics of the audio stream; and transmitting additional payload in the hidden sub-channel as part of a composite audio stream, the composite audio stream including the additional payload and narrowband components of the audio stream for which the perceptual mask was estimated. The composite stream is preferably an analog signal.

In an embodiment, the method can further include the step of partitioning an original analog audio stream into audio segments. The step of partitioning can be performed prior to the steps of estimating, dynamically allocating and transmitting, in which case the steps of estimating, dynamically allocating, and transmitting are performed in relation to each audio segment.

In another embodiment, relating to component replacement, the step of adding additional payload can include: removing an audio segment component from within the hidden sub-channel; and adding the additional payload in place of the removed audio segment component. Contents of the additional payload can be determined based on characteristics of the original analog audio stream. The step of adding the additional payload can include encoding auxiliary information into the additional payload, the auxiliary information relating to how the additional payload should be interpreted in order to correctly restore the additional payload at a receiver.

In another embodiment, relating to magnitude perturbation, the step of adding additional payload includes adding a noise component within the hidden sub-channel, the noise component bearing the additional payload and preferably being introduced as a perturbation to a magnitude of an audio component in the frequency domain. In such a case, the method can further include the steps of: transforming the audio segment from the time domain to the frequency domain; calculating a magnitude of each frequency component of the audio segment; determining a magnitude and sign for each frequency component perturbation; perturbing each frequency component by the determined frequency component perturbation; quantizing each perturbed frequency component; and transforming the audio segment back to the time domain from the frequency domain. The perturbation can be uncorrelated with other noises, such as channel noise.

In another embodiment, relating to bit manipulation, the audio stream is a digital audio stream, and the step of transmitting the additional payload includes modifying certain bits in the digital audio stream to carry the additional payload.

In a further embodiment, the additional payload includes data for providing a concurrent service. The concurrent service can be selected from the group consisting of: instant calling line identification; non-interruption call waiting; concurrent text messaging; display-based interactive services.

In a still further embodiment, the additional payload includes data from the original analog audio stream for virtually extending the bandwidth of the audio stream. The data from the original analog audio stream can include data from a lower band, from an upper band, or from both an upper band and a lower band.

In another aspect, the present invention provides an apparatus for transmitting an audio stream. The apparatus includes a perceptual mask estimator for estimating a perceptual mask for the audio stream, the perceptual mask being based on a human auditory system perceptual threshold. The apparatus also includes a hidden sub-channel dynamic allocator for dynamically allocating a hidden sub-channel below the estimated perceptual mask for the audio stream, the dynamic allocation being based on characteristics of the audio stream. The apparatus further includes a composite audio stream generator for generating a composite audio stream by including additional payload in the hidden sub-channel of the audio stream. The apparatus finally includes a transceiver for receiving the audio stream and for transmitting the composite audio stream. The apparatus can further include a coder for coding only an upper-band portion of the audio stream.

In a further aspect, the present invention provides an apparatus for receiving a composite audio stream having additional payload in a hidden sub-channel of the composite audio stream. The apparatus includes an extractor for extracting the additional payload from the composite audio stream. The apparatus also includes an audio stream reconstructor for restoring the additional payload to form an enhanced analog audio stream. The apparatus finally includes a transceiver for receiving the composite audio stream and for transmitting the enhanced audio stream for listening by a user.

In the apparatus for receiving a composite audio stream, the extractor can further include means for estimating a perceptual mask for the audio stream, the perceptual mask being based on a human auditory system perceptual threshold. The extractor can also include means for determining the location of the additional payload. The extractor can still further include means for decoding auxiliary information from the additional payload, the auxiliary information relating to how the additional payload should be interpreted in order to correctly restore the additional payload. The extractor can also further include an excitation deriver for deriving an excitation of the audio stream based on a received narrowband audio stream. The excitation can be derived by using an LPC scheme.

In a still further aspect, the present invention provides a method of communicating an audio stream. The method includes the following steps: coding an upper-band portion of the audio stream; transmitting the coded upper-band portion and an uncoded narrowband portion of the audio stream; decoding the coded upper-band portion of the audio stream; and reconstructing the audio stream based on the decoded upper-band portion and the uncoded narrowband portion of the audio stream. The step of coding the upper-band portion of the audio stream can include the following steps: determining linear predictive coding (LPC) coefficients of the audio stream, the LPC coefficients representing a spectral envelope of the audio stream; and determining gain coefficients of the audio stream. The upper-band portion of the audio stream can be coded and decoded by an upper-band portion of an ITU G.722 codec, or by an LPC coefficient portion of an ITU G.729 codec.

In a yet further aspect, the present invention provides an apparatus for communicating an audio stream. The apparatus includes the following elements: a coder for coding an upper-band portion of the audio stream; a transmitter for transmitting the coded upper-band portion and an uncoded narrowband portion of the audio stream; a decoder for decoding the coded upper-band portion of the audio stream; and a reconstructor reconstructing the audio stream based on the decoded upper-band portion and the uncoded narrowband portion of the audio stream.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
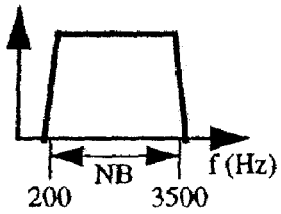
FIG. 1 PRIOR ART
FIG. 1 is an illustration representing the bandwidth of an NB channel in the frequency domain.

Generally, the present invention provides a method and system for increasing the information carrying capacity of an audio signal. A method and apparatus are provided for communicating an audio stream. A perceptual mask is estimated for an audio stream, based on the perceptual threshold of the human auditory system. A hidden sub-channel is dynamically allocated substantially below the estimated perceptual mask based on the characteristics of the audio stream, in which additional payload is transmitted. The additional payload can be related to components of the audio stream that would not otherwise be transmitted in a narrowband signal, or to concurrent services that can be accessed while the audio stream is being transmitted. The payload can be added in place of removed components from within the hidden sub-channel, or as a noise perturbation in the hidden sub-channel, imperceptible to the human ear. A suitable receiver can recover the additional payload, whereas the audio stream will be virtually unaffected from a human auditory standpoint when received by a traditional receiver. A coding scheme is also provided in which a portion of a codec is used to code an upper-band portion of an audio stream, while the narrowband portion is left uncoded.

The term "audio stream" as used herein represents any audio signal originating from any audio signal source. An audio stream can be, for example, one side of a telephone conversation, a radio broadcast signal, audio from a compact disc or other recording medium, or any other signal, such as a videoconference data signal, that has an audio component. Although analog audio signals are discussed in detail herein, this is an example and not a limitation. When an audio stream includes components that are said to be "substantially below" a perceptual mask, as used herein, this means that the effect of those components is imperceptible, or substantially imperceptible, to the human auditory system. In other words, if a hidden sub-channel is allocated "substantially below" an estimated perceptual mask, and additional payload is transmitted in the hidden sub-channel, inclusion of such additional payload is inaudible, or substantially inaudible, to an end user.

The term "codec" as used herein represents any technology for performing data conversion, such as compressing and decompressing data or coding and decoding data. A codec can be implemented in software, firmware, hardware, or any combination thereof. The term "enhanced receiver" as used herein refers to any receiver capable of taking advantage of, and interpreting, additional payload embedded in an audio signal.

According to psycho-acoustics, the presence of an audio component raises the human ear's hearing threshold to another sound that is adjacent in time or frequency domain and to the noise in the audio component. In other words, an audio component can mask other weaker audio components completely or partially.

The concept behind embodiments of the present invention is to make use of the masking principle of the human auditory system (HAS) and transmit audio components bearing certain additional payload substantially below, and preferably entirely below, the perceptual threshold. Although the payload-bearing components are not audible to the human ear, they can be detectable by a certain mechanism at the receiver, so that the payload can be extracted.

While there can be various schemes of implementing the concept of the invention, three main examples are discussed herein. These three implementation schemes for the invention are "component replacement" (CR), "magnitude perturbation" (MP), and "bit manipulation" (BM). They make use of the HAS properties described above. There is also a compression scheme according to an embodiment of the present invention, which can be used with any one of these, or any other, audio stream communication schemes. Moreover, although there are various applications of embodiments of the present invention, these applications are discussed herein in relation to two broad categories: concurrent services and bandwidth extension.

In terms of a scheme that extends the capacity of an NB channel, the preferred features thereof are simplicity, compatibility with the existing end-user equipment, and a payload rate higher than that offered by existing audio watermarking schemes while the stringent security requirement incurred by them can be eased.

Embodiments of the present invention are preferably simply implemented as firmware, and hardware requirements, if any, are preferably minimized. Any need for special hardware, e.g., a modem, is preferably eliminated. This feature is important since embodiments of the present invention seek to provide a cost-effective solution that users can easily afford. An apparatus, such as a codec, can be used to implement methods according to embodiments of the present invention. The apparatus can be integrated into an enhanced receiver, or can be used as an add-on device in connection with a conventional receiver.

A conventional receiver, such as a conventional phone terminal, e.g. a POTS, should still be able to access the basic voice service although it cannot access features associated with the additional payload. This is particularly important in the audio broadcasting and conferencing operations, where a mixture of POTSs and phones capable of accessing the additional payload can be present. Furthermore, being compatible with the existing equipment will greatly facilitate the phase-in of new products according to embodiments of the present invention.

Note that in terms of "easing the security requirement" with respect to previous audio watermarking techniques, this refers to the fact that the additional payload in embodiments of the invention can possibly be destroyed or deleted by an intentional attacker as long as he/she knows the algorithm with which the payload has been embedded. This doesn't necessarily mean that the attacker can obtain the information residing in the payload; certain encryption schemes can be used so that a potential attacker is not able to decode the information in the payload.

Before discussing any of the implementation schemes or applications in detail, a general discussion of embodiments of the present invention will be provided. This general discussion applies to aspects of the invention that are common to each of the implementations and applications.

Figure 2:
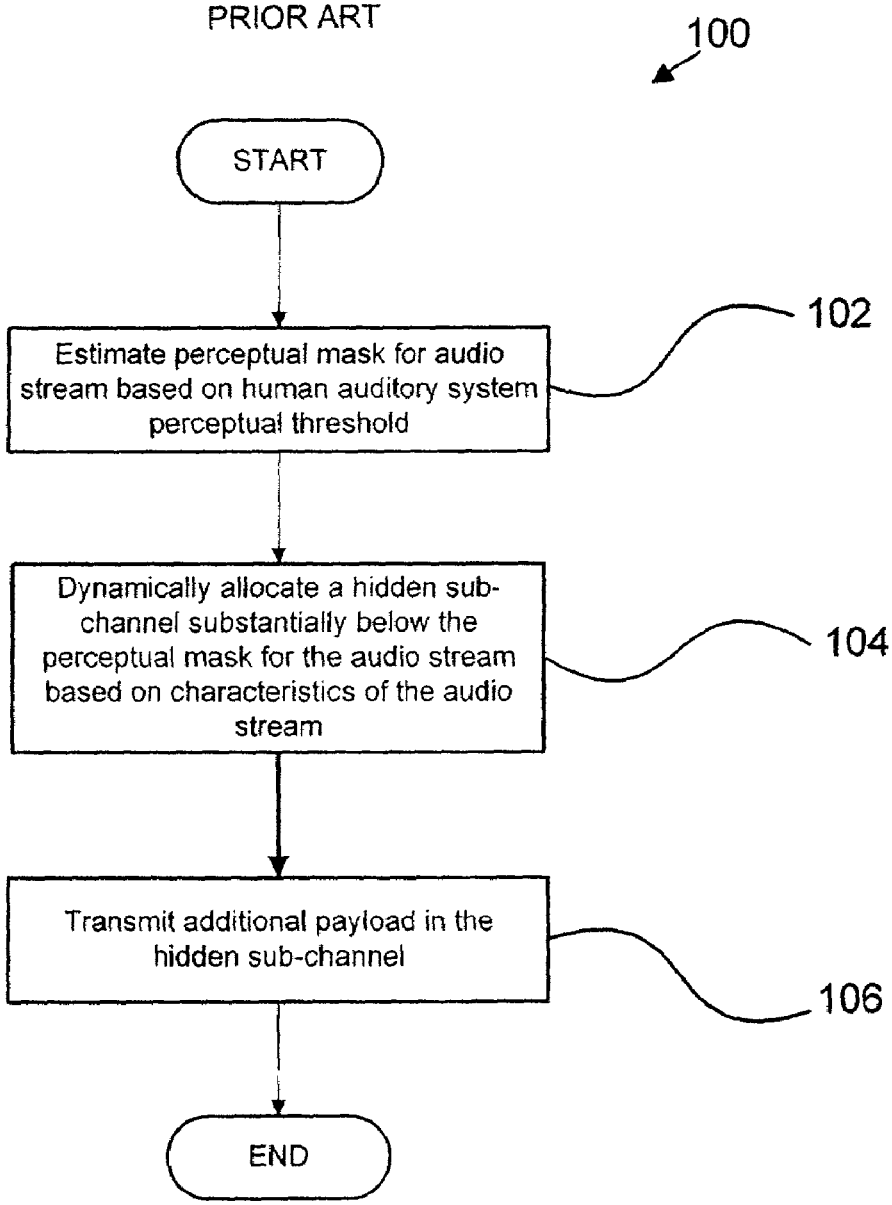
FIG. 2 is a flowchart illustrating a method of transmitting an audio stream according to an embodiment of the present invention.

FIG. 2 is a flowchart illustrating a method 100 of transmitting an audio stream according to an embodiment of the present invention. The method 100 begins with step 102 of estimating a perceptual mask for the audio stream. The perceptual mask is based on a human auditory system perceptual threshold. Step 104 includes dynamically allocating a hidden sub-channel substantially below the estimated perceptual mask for the audio stream. The dynamic allocation is based on characteristics of the audio stream itself, not on generalized characteristics of human speech or any other static parameter or characteristic. For example, the dynamic allocation algorithm can constantly monitor the signal components and the estimated perceptual mask in the time or a transform domain, and allocate the places where the signal components are substantially below, and preferably entirely below, the estimated perceptual mask as those where the hidden sub-channel can be located. In another example, the dynamic allocation algorithm can also constantly monitor the signal components and the estimated perceptual mask in the time or a transform domain, then alterations that are substantially below the estimated perceptual mask and that bear the additional payload are made to the signal components. These alterations are thus in a so-called sub-channel.

Finally, in step 106 additional payload is transmitted in the hidden sub-channel. The resulting transmitted audio stream can be referred to as a composite audio stream. Prior to performing step 102, the method can alternatively include a step of partitioning the audio stream into audio stream segments. In such a case, each of steps 102, 104 and 106 are performed with respect to each audio stream segment. Note that if the entire stream is treated rather than individual audio segments, some advantages of the presently preferred embodiments may not be achieved. For example, when manipulation is done on a segment-by-segment basis, there is no need to have manipulation done on a periodic basis, which is easier to implement. Also, it is not necessary to have a constant stream in order to perform the manipulation steps, which adds flexibility to the implementation. Of course, it is presumed that prior to performing step 102, the audio stream is received in a manner suitable for manipulation, as will be performed in the subsequent steps. As will be described later, the method of receiving and processing a composite audio stream to recover the additional payload essentially consists of a reversal of the steps taken above.

Figure 3:
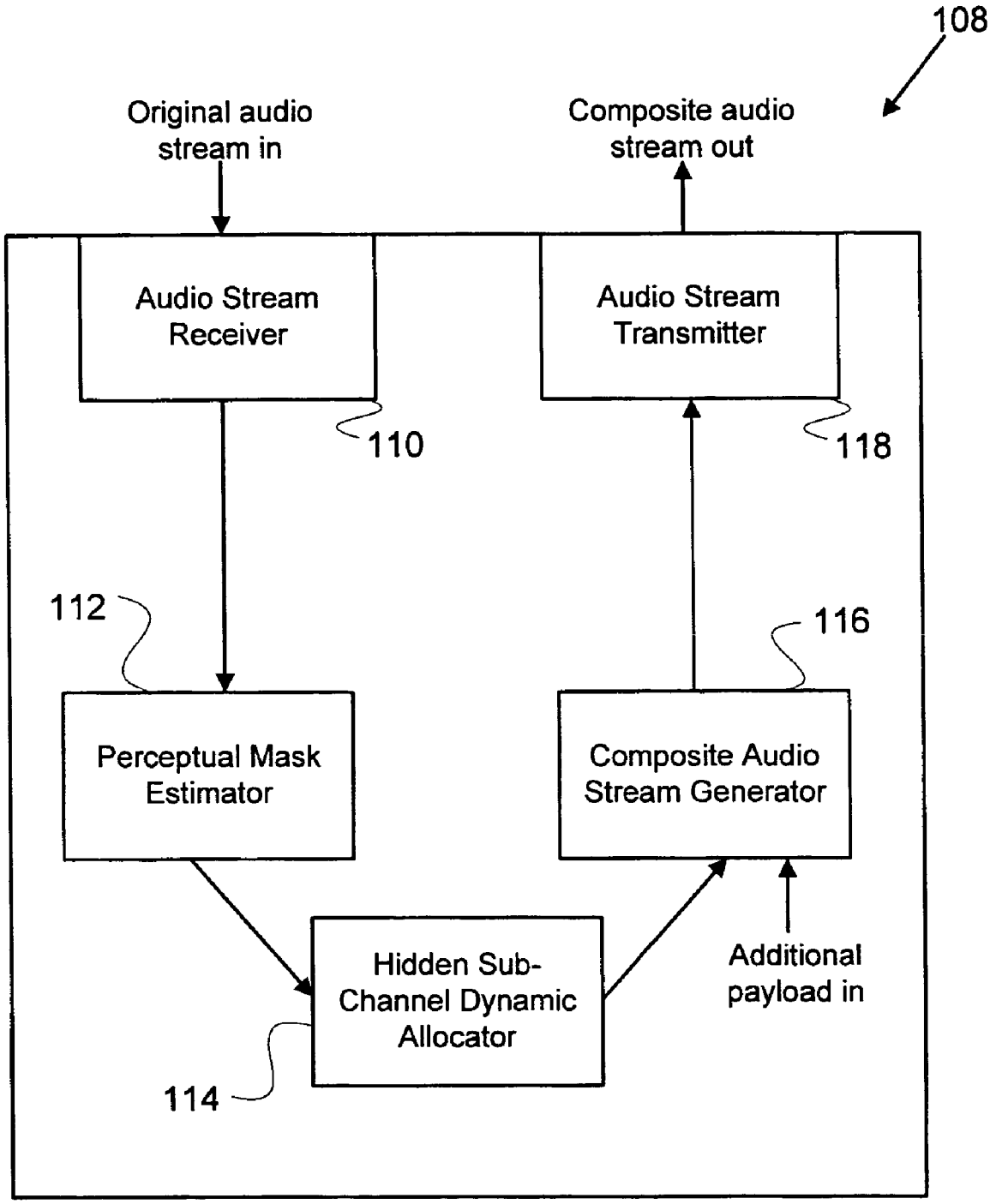
FIG. 3 is a block diagram of an apparatus for transmitting an audio stream according to an embodiment of the present invention.

FIG. 3 is a block diagram of an apparatus 108 for transmitting an audio stream according to an embodiment of the present invention. The apparatus 108 comprises components for performing the steps in the method of FIG. 2. The apparatus includes a receiver 110, such as an audio stream receiver or transceiver, for receiving the audio stream. The receiver 110 is in communication with a perceptual mask estimator 112 for estimating a perceptual mask for the audio stream, the perceptual mask being based on a human auditory system perceptual threshold. The estimator 112 is itself in communication with a hidden sub-channel dynamic allocator 114 for dynamically allocating a hidden sub-channel substantially below the estimated perceptual mask for the audio stream, the dynamic allocation being based on characteristics of the audio stream. The dynamic allocator 114 is, in turn, in communication with a composite audio stream generator 116 for generating a composite audio stream by including additional payload in the hidden sub-channel of the audio stream. The additional payload can be based on information from the initially received audio stream for bandwidth expansion, or can be other information from an external source relating to concurrent services to be offered to the user. The composite audio stream generator 116 is in communication with transmitter 118, such as an audio stream transmitter or transceiver, for transmitting the composite audio stream to its intended recipient(s). Of course, the receiver 110 and the transmitter 118 can be advantageously implemented as an integral transceiver.

The three implementation schemes for the invention, i.e. "component replacement" (CR), "magnitude perturbation" (MP), and "bit manipulation" (BM), will now be discussed.

The Component replacement (CR) embodiment of the invention replaces certain audio components that are under the perceptual threshold with others that bear the additional payload. The CR scheme first preferably breaks an audio stream into time-domain segments, or audio segments, then processes the audio segments one by one. Conceptually, it takes the following steps to process each audio segment. Although these steps relate to an audio segment, it is to be understood that they can alternatively be applied to the audio stream itself.

At the CR transmitter:

1. The audio segment is analyzed and the perceptual mask estimated, a threshold below which signal components cannot be heard by the human ear. The perceptual mask can be estimated, for example, by using an approach similar to, and maybe a simplified version of, that specified in MPEG standards 2. Audio components below the perceptual mask are removed, so that some holes in the signal space of the audio segment are created. This operation does not create audible artifacts since the components that are taken away are below, or substantially below, the perceptual mask.

3. A composite audio segment is formed by filling these holes with components that carry the additional payload, which are still substantially below the perceptual threshold so that this operation will not result in audible distortion either.

4. While Step "3." above is performed, certain auxiliary information, if necessary, is also encoded into the added components. An enhanced receiver will rely on this information to determine how the added components should be interpreted in order to correctly restore the additional payload.

During transmission:

5. The composite audio segment/stream is sent through an audio channel, such as a one associated with the PSTN, digital PBX, or VoIP, to the remote receiver. There may be channel degradations, such as parasitic or intentional filtering and additive noise, taking place along the way.

At a traditional receiver, such as a POTS receiver:

6. A POTS will treat the received signal as an ordinary NB audio signal and send it to its electro-acoustic transducer as usual, such as a handset receiver or a hands free loudspeaker, in order for the user to hear the audio. Since the changes made by the replacement operations are under the perceptual threshold, they will not be audible to the listener.

At an enhanced receiver, such as a receiver equipped with a codec for the CR scheme:

7. The received composite segment/stream is analyzed and the perceptual mask estimated. This mask is, to a certain accuracy tolerance, a replica of that obtained in Step "1." above, at the transmitter. Since in Step "3." above, the added components that carry the additional payload are substantially below the perceptual threshold, they will also be substantially below the perceptual threshold estimated in this stage. This makes them distinguishable from the original audio components, i.e., those that were not replaced.

8. Based on the estimated perceptual mask, the locations of the added components are determined and these components extracted from the audio signal.

9. The auxiliary information, encoded into the added components in Step "4." above, is decoded, such as by an extractor.

10. The additional payload is restored, for example by an audio stream reconstructor, based on the information obtained in Steps "8." and "9." above.

In the apparatus for receiving a composite audio stream, such as an enhanced receiver or transceiver, the extractor can further include means for estimating a perceptual mask for the audio stream, the perceptual mask being based on a human auditory system perceptual threshold. The extractor can also include means for determining the location of the additional payload. The extractor can still further include means for decoding auxiliary information from the additional payload, the auxiliary information relating to how the additional payload should be interpreted in order to correctly restore the additional payload.

Figure 4:
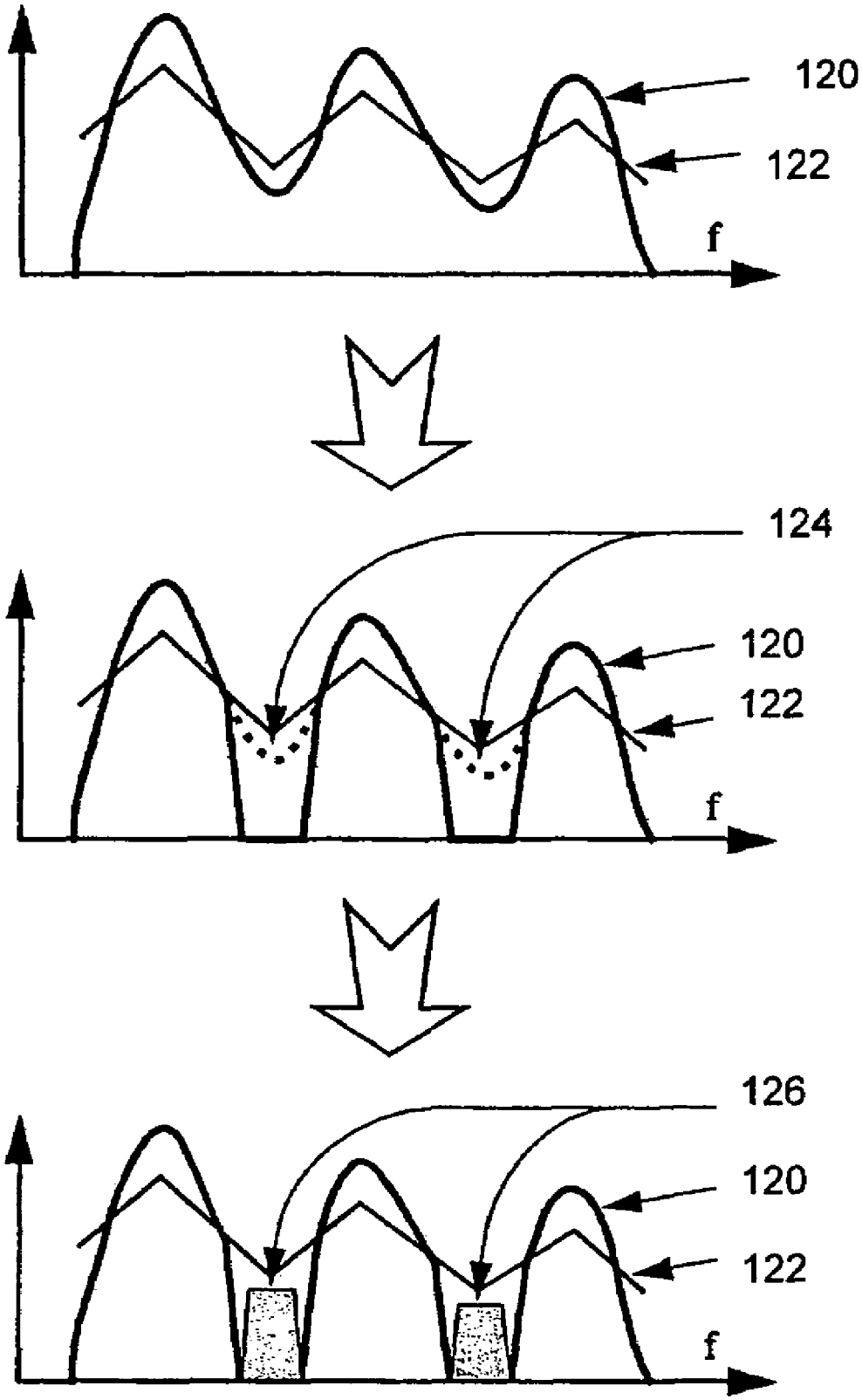
FIG. 4 is an illustration, in the frequency domain, of a component replacement scheme according to an embodiment of the present invention.

A CR example where only frequency domain operations are considered is illustrated in FIG. 4. The example in FIG. 4 shows an original audio signal spectrum 120 as it is related to an estimated perceptual mask 122. Audio segment components 124 are removed from within the hidden subchannel and are replaced by added components 126 containing the additional payload.

The CR scheme is now compared to traditional approaches. Although the approach in FIG. 4 appears somewhat like a "frequency division multiplexing" approach, there are distinct differences. In fact, based on the signal characteristics at any given time, the CR scheme dynamically allocates the regions where signal components can be replaced, while those in the prior art used fixed or semi-fixed allocation schemes, i.e., certain signal components are replaced no matter how prominent they are. As a result, the approach according to an embodiment of the present invention minimizes the degradation to the subjective audio quality while maximizing the additional payload that can be embedded and transmitted.

The CR scheme is different from ITU G.722 and G.722.1 WB vocoders in that the latter two vocoders are strictly waveform digital coders, which try to reproduce the waveform of the original audio and transmit the information via digital bits, while CR is an analog perceptual scheme, which transmits an analog signal with inaudible additional payload embedded. The only thing in common between the CR scheme and the MPEG audio coding/decoding schemes discussed in the background is that they all make use of psychoacoustics to estimate the perceptual threshold, although the psycho-acoustic model that CR scheme uses can be much simpler than that used in MPEG schemes. Once a perceptual mask has been derived, CR scheme takes a completely different direction; it replaces certain audio components with something else, while the MPEG schemes remove those components altogether, not to mention that embodiments of the present invention advantageously output an analog signal while the MPEG schemes output digital bits.

The CR scheme differs from the SVD schemes discussed in the background in that it is compatible with the conventional telephone equipment, e.g., a POTS can still access the NB audio portion although it is not able to get the additional payload, while a POTS cannot even access the voice portion of a system with an SVD scheme implemented. The CR scheme serves different purposes than do audio watermarking schemes, as discussed in the background. It is for a large payload rate and a low security requirement while the security requirement for an audio watermarking scheme is paramount and the payload rate is much less an issue. Thus, an audio watermarking scheme would be quite inefficient if used for the purpose of extending the capacity of an NB audio channel, and the CR scheme would not provide a good enough security level if one uses it to implement an audio watermarking.

As a final remark on the CR scheme, although the use of masking properties in the time domain to extend the capacity of an NB audio channel is not specifically discussed here, an implementation that does so is within the scope of the present invention, because the common feature of making use of the HAS' masking principle and transmitting audio components bearing additional payload substantially below the perceptual threshold is employed.

Figure 5:
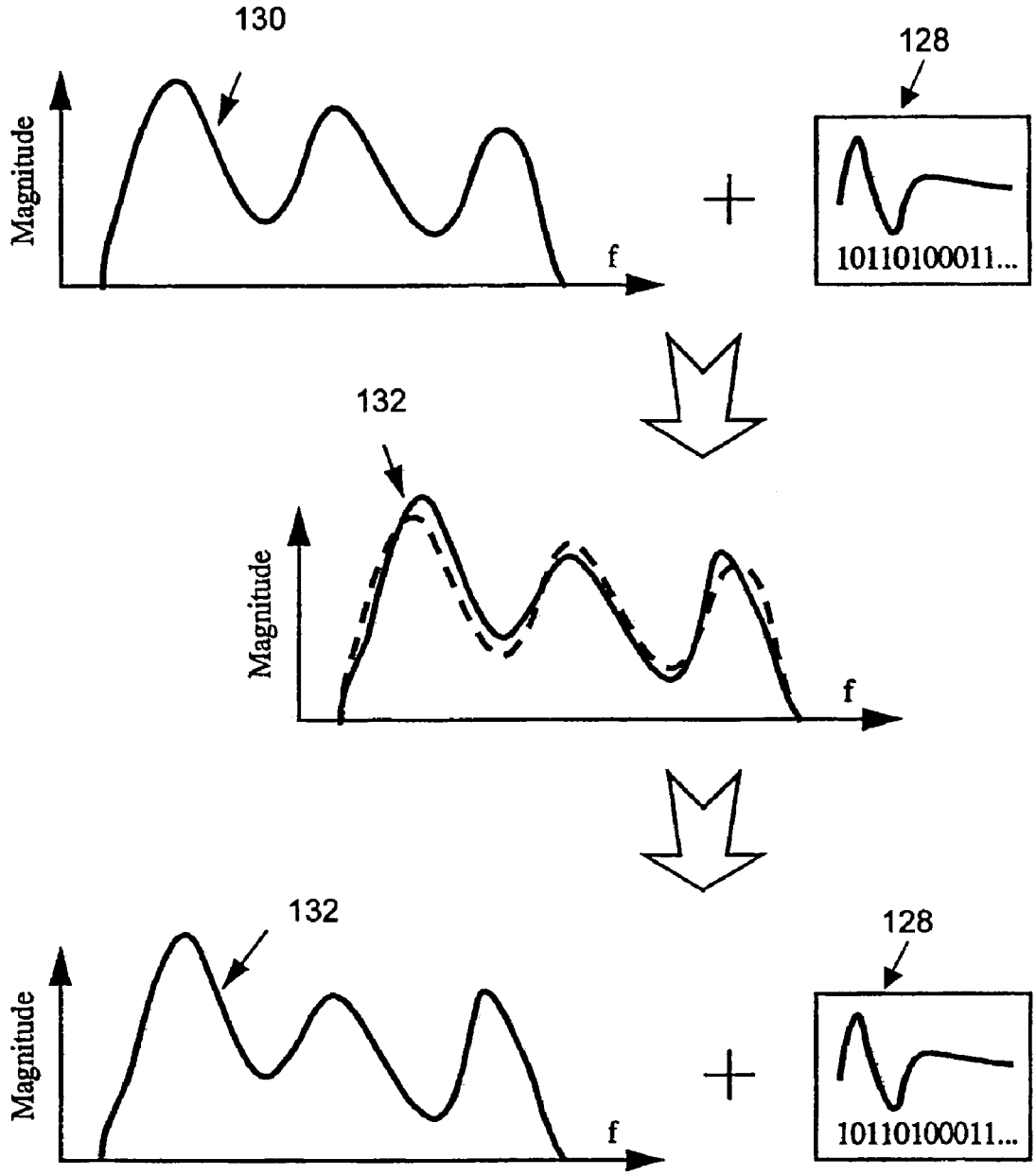
FIG. 5 is an illustration, in the frequency domain, of a magnitude perturbation scheme according to an embodiment of the present invention.

The second embodiment of the present invention is the magnitude perturbation (MP) implementation. This embodiment, unlike component replacement, does not replace any components in the original audio signal. Instead, it adds certain noises that are substantially below, and preferably entirely below, the perceptual threshold to the original audio signal, and it is these noises that bear the additional payload. The noises are introduced as perturbations to the magnitudes of the audio components in the time domain or a transform domain, such as the frequency domain. It should be noted that the perturbations introduced are in general uncorrelated with other noises such as the channel noise; therefore, the receiver is still able to restore the perturbations in the presence of moderate channel noise. The concept of the MP scheme is illustrated in relation to the frequency domain in FIG. 5, wherein additional payload 128 is to be added to original signal spectrum 130. Perturbed signal 132 represents the combination of the original signal spectrum 130 when perturbed as per the additional payload 128, and is compared to the original signal spectrum shown as a dashed curve. The bottom of FIG. 5 illustrates the situation at the enhanced receiver where the additional payload 128 can be restored from the perturbed signal spectrum 132.

Figure 6:
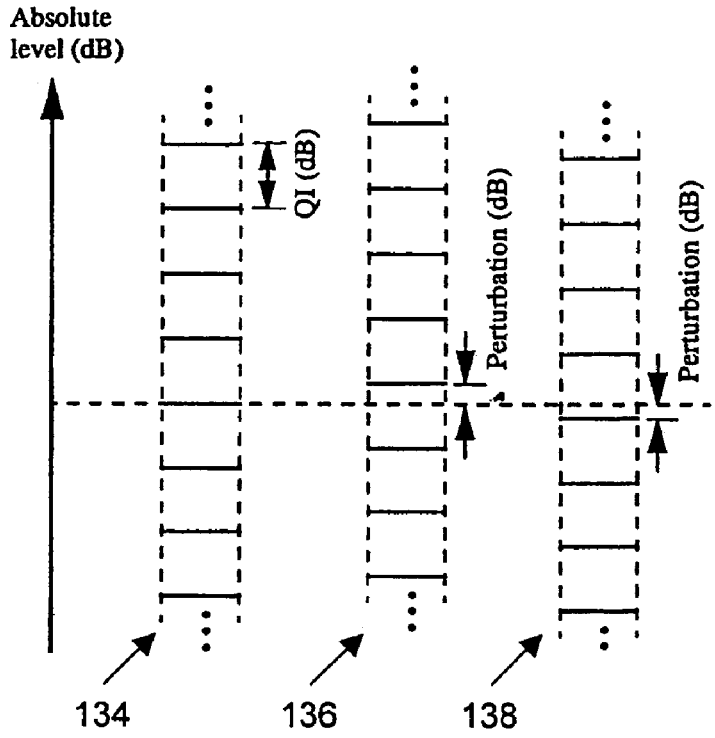
FIG. 6 is an illustration of a quantization grid used in the magnitude perturbation scheme according to an embodiment of the present invention.

An important concept relating to the specific implementation of the MP scheme is the "quantization grid" (QG), which consists of a series of levels, or magnitude values, that are uniformly spaced in a logarithmic scale. The difference between two adjacent such levels is called the quantization interval, or QI (in dB). As shown in FIG. 6, the ladder-like QG, i.e., set of those levels, can go up and down as a whole, depending on the perturbation introduced, but the relative differences between those levels remain the same, being QI. For example, quantization grid 134 represents an equilibrium QG, with no perturbation. Quantization grid 136 represents a QG with a positive perturbation, whereas quantization grid 138 represents a QG with a negative perturbation.

The idea behind the MP scheme is:

1. at the transmitter, to quantize the magnitude of each frequency component of the signal to the closest level in a QG with a certain perturbation and, 2. at the receiver, to extract the perturbations that the transmitter has applied to the components. Both the magnitude and the sign of each perturbation can be utilized to bear the additional payload.

Since, after the application of the perturbation, the magnitude of each signal component can only take a finite number of discrete values that are QI dB apart, the MP scheme inevitably introduces noise to the audio signal. Obviously, QI must be large enough for the receiver to reliably detect the perturbations with the presence of channel noise, but small enough for the perturbation not to be audible. In experimental results, it was found that a QI of about 2 or 3 dB works well and is preferable.

The MP transmitter preferably partitions the original audio stream into non-overlapped frames and processes them one after another. Conceptually, it takes the following steps to process each frame.

1. The audio frame is transformed into a transform domain, such as the frequency domain, and the magnitude of each frequency component is calculated. Note that a window function may be applied to the frame before the transform.

2. The magnitude and the sign of the perturbation for each frequency bin are determined as per the additional payload being embedded. This is done according to a predetermined protocol—an agreement between the transmitter and the receiver. The magnitude of the perturbation should not exceed a certain limit, say, QI÷3 dB, in order to avoid potential ambiguity to the receiver. Then, the QG corresponding to each frequency bin is moved up or down as per the required perturbation value.

3. The magnitude of each signal component is perturbed by being quantized to the nearest level in its corresponding perturbed QG.

4. An inverse (to what was performed in Step "1." above) transform is performed on all the signal components, which are in the transform domain, to arrive at a new time-domain frame that closely resembles the original one but with the perturbations embedded.

5. The signal sequence consisting of non-overlapped consecutive such frames is transmitted to the receiver.

During transmission:

6. The signal sequence is sent through an NB audio channel, such as that with a digital PBX, the PSTN, or VoIP, to the remote receiver. If the PSTN is the media, there may be channel degradations, such as parasitic or intentional filtering and additive noise, taking place along the way.

At a traditional receiver, such as a POTS receiver:

7. A POTS will treat the received signal as an ordinary audio signal and send it to its electro-acoustic transducer such as a handset receiver or a handsfree loudspeaker. Since the changes made by the MP operations are under the perceptual threshold, they will not be audible to the listener.

At an enhanced receiver, such as a receiver equipped with a codec for the MP scheme:

8. If the transmission channel contains analog elements, such as the PSTN, the received time sequence may need to undergo some sort of equalization in order to reduce or eliminate the channel dispersion. The equalizer should generally be adaptive in order to be able to automatically identify the channel characteristics and track their drifts. Channel equalization is beyond the scope of the present invention and therefore will not be further discussed here.

Figure 7:
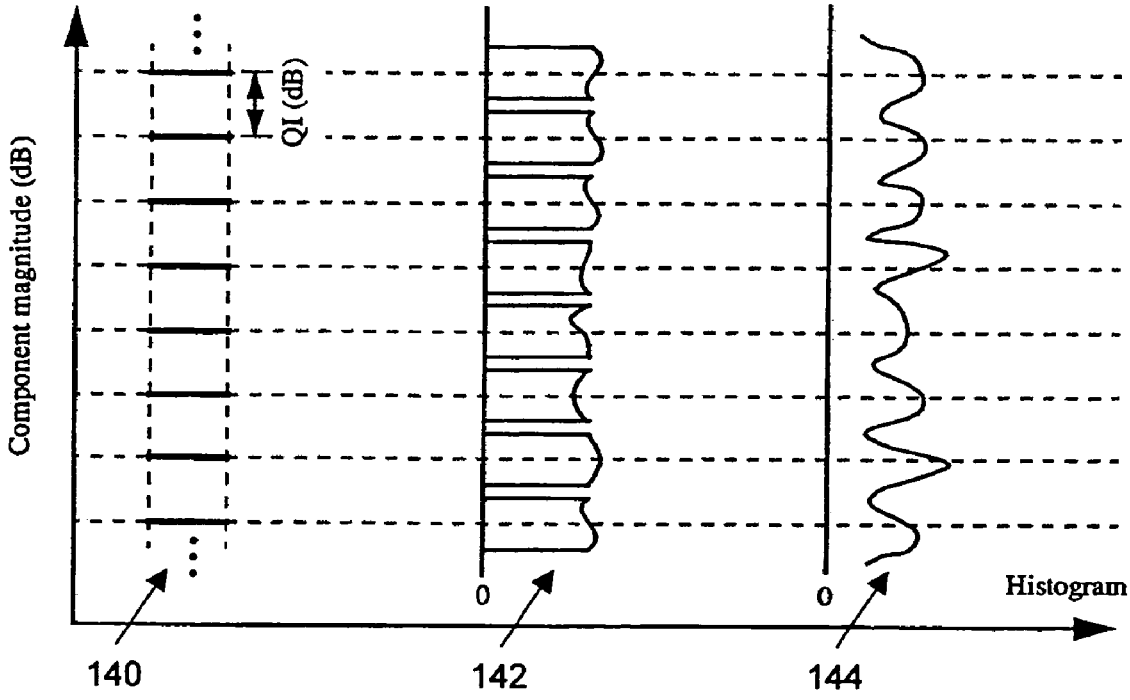
FIG. 7 is an illustration of the criterion for correct frame alignment according to an embodiment of the present invention.

9. The time sequence is then partitioned into frames. The frame boundaries are determined by using an adaptive phase locking mechanism, in an attempt to align the frames assumed by the receiver with those asserted by the transmitter. The criterion to judge a correct alignment is that the magnitude distributions of components in all frequency bins are concentrated in discrete regions as opposed to being spread out. This is illustrated in FIG. 7 in which histogram 140 represents equilibrium QG, histogram 142 represents receive and transmit frames being correctly aligned, and histogram 144 represents receive and transmit frames being mis-aligned.

10. The equilibrium position of the QG for each frequency bin needs to be determined. This can be achieved by examining the histogram of the magnitudes over a number of past frames, as shown in FIG. 7.

11. With the above done, the perturbation that the transmitter applied to a signal component, in a certain frequency bin, can be easily determined as the offset of the component magnitude from the nearest level in the corresponding equilibrium QG.

12. Last, the embedded additional payload can be decoded based on the perturbation values restored.

Note that on system start up, the receiver typically needs some time, of up to a few seconds maybe, to acquire phase locking and determine QG positions, i.e., Steps "9." and "10." above, respectively. During this period, it is not possible to transmit the additional payload.

The MP scheme is different from most of the traditional approaches, in terms of the operation principles. The MP scheme studied in this section is different from ITU. G.722 and ITU G.722.1 WB vocoders and the MPEG audio coding/decoding schemes discussed in the background in that the latter are all waveform digital coders, which try to reproduce the waveform of the original audio and transmit the information via digital bits, while MP is an analog perceptual scheme, which transmits an analog signal with inaudible additional payload embedded.

The SVD schemes discussed in the background uses offsets larger than the audio signal, while the MP scheme uses perturbations much smaller than the audio signal, to bear the additional payload. As a result, the MP is compatible with the conventional telephone equipment while the SVD is not. In other words, with the MP scheme, a POTS can still access the NB audio portion although not able to get the additional payload, while a POTS cannot access the voice portion of a system with an SVD scheme implemented. Because of their difference in level of the embedded information, their detection methods are completely different.

The MP scheme serves a different purpose than do audio watermarking schemes, discussed in the background. It is for a large payload rate and a low security requirement while the security requirement for an audio watermarking scheme is paramount and the payload rate is much less an issue. Thus, an audio watermarking scheme would be quite inefficient if used for the purpose of extending the capacity of an NB audio channel, and the MP scheme would not provide a good enough security level if one uses it to implement an audio watermarking.

As a general note regarding the CR and MP schemes, these schemes can be used with either analog signals or digital signals. When used with an analog signal, the analog signal is converted to a digital signal for processing, but the output is returned to an analog signal. However, these schemes can also be used with digital signals.

The third embodiment of the present invention is the bit manipulation (BM) implementation. If the transmission media are digital, then there is a potential to modify the digital samples in order to transmit certain additional payload. The issues in such a case are, therefore: 1) to code the additional payload with as few digital bits as possible, and 2) to embed those bits into the digital samples in such a way so that the noise and distortion caused are minimized.

The first issue above is associated with the source coding technology, i.e., to code the information with a minimum number of bits. This issue will be discussed later in relation to a coding scheme for audio stream communication according to an embodiment of the present invention. The second issue may not be a big one if the data samples are with a high resolution, e.g., the 16-bit linear format that is widely used in audio CDs. This is because, at such a high resolution, certain least significant bits (LSBs) of the data samples can be modified to bear the additional payload with little audible noise and distortion. When the data format is 8-bit companded, i.e., μ-law or A-law, specified in ITU-T G.711, the quantization noise is high, being around the audibility threshold; therefore, there is not much room left to imperceptibly accommodate the noise and distortion associated with the additional payload.

Thus, when directly applied to an 8-bit companded data format, a conventional LSB modification scheme will likely be unacceptable because of the large audible noise it generates. Since the μ-law and A-law formats are the most popular data formats of telephony systems world-wide, a scheme that overcomes the above difficulties and is able to create a hidden channel over these data formats will be very useful. The proposed "bit manipulation" (BM) attempts to solve the issue. Although the BM scheme is advantageously employed with telephony systems, and other systems, that employ an 8-bit companded data format, the BM scheme is also suitable for transmission media of other data formats, such as the 16-bit linear one.

According to the bit manipulation implementation, certain bits in a digital audio signal are modified, in order to carry the additional payload. For example, a bit manipulation implementation can make use of one component replacement bit in an audio stream. The bit is preferably the least significant bit (LSB) of the mantissa, not the exponent. This component replacement bit is replaced every 2 or 3 samples, creating little noise or artefacts. The component replacement bit is removed and replaced by a bit that contains additional payload, such as upper band information up to 7 kHz from the original audio stream. The bit manipulation implementation will be discussed later in further detail with respect to a specific example in conjunction with a coding scheme, as will now be discussed.

A coding scheme for audio stream communication, according to an embodiment of the present invention, is preferably used in conjunction with any one of the transmission implementations (i.e. CR, MP and BM) discussed above. However, it is to be understood that the coding scheme for audio stream communication can be used in conjunction with any other audio stream communication scheme in order to improve the audio stream compression prior to transmission.

In a coding scheme according to an embodiment of the present invention, only a portion of an existing coding scheme is used. The idea, as in any coding scheme, is to reduce the amount of data to be transmitted. However, according to embodiments of the present invention, it was discovered that it is possible to only use a portion of some existing coding schemes, with some modifications, and still achieve good transmission characteristics, while reducing the amount of data to be transmitted. Specifically, an upper band portion of an audio stream is encoded, while a narrowband portion of the audio stream is transmitted in uncoded form. This saves on processing power at the transmit side, and also reduces the number of bits that must be transmitted, thereby improving the efficiency of the transmission. Moreover, since less bits need to be decoded at the receiver, the process is also simplified at that stage. Two specific examples of coding schemes according to embodiments of the present invention are: the use of the upper-band portion of ITU-T G.722 voice encoder/decoder (codec); and the coding of linear predictive coding (LPC) coefficients and gain. They are discussed below.

Firstly, consider the use of the upper-band portion of ITU-T G.722 voice codec. The G.722 codec is a waveform coder, which tries to preserve/reproduce the shape of the waveform at the receiver end. The decoded output waveform resembles the uncoded input waveform. The upper-band portion of ITU-T G.722 voice encoder/decoder (codec) uses a rate of 16 kbits/s to code the upper-band voice, i.e., between 4000 and 7000 Hz. In a particular embodiment, this upper-band portion of the G.722 codec is used to code an upper-band of an original audio stream, whereas a narrowband portion of the original audio stream does not undergo any coding. The upper-band portion of the codec is used at a halved rate, i.e., 8 kbits/s, preferably after the original audio stream has been frequency downshifted, prior to the sampling rate reduction, in order to comply with Nyquist's theorem. This way, an extra audio bandwidth of about 1.5 kHz can be transmitted by using 1 bit from each NB data word. This coding method can extend the upper limit of the audio bandwidth to around 5 kHz. Although good with the 16-bit linear data format, this method, modifying 1 bit every NB data sample, sometimes causes an audible noise with an 8-bit companded data format. A particular example will be described in further detail later in the description with respect to an example of a coding-assisted bit manipulation implementation of an embodiment of the present invention for achieving bandwidth extension.

The second example of a coding scheme according to an embodiment of the present invention involves coding LPC coefficients and gain. It is useful at this point to consider the ITU-T G.729 NB voice codec, which is a parametric coder based on a speech production module. The G.729 codec tries to reproduce the subjective effect of a waveform, with the waveform of the decoded output possibly being different from that of the uncoded input, but sounding the same to the human ear. Every 10 ms frame (80 NB data samples), the parameters transmitted by a G.729 encoder consist of: parameters for LPC coefficients (18 bits); and parameters for the faithful regeneration of the excitation at the decoder (62 bits). This results in a total of 80 bits per frame, or 1 bit per data sample. The bits used to represent the parameters for regeneration of the excitation also include information relating to the gain of the signal, such information being spread throughout some of the 62 bits.

A particular advantage of this embodiment of the present invention is the ability to only transmit the parameters for the LPC coefficients (18 bits required with G.729) and about 5 bits for the gain—totalling 18+5=23 bits, as opposed to 80, per frame. In this embodiment, the excitation signal, being not encoded at the transmitter, is derived at the receiver from the received NB signal by using an LPC scheme, such as an LPC lattice structure. Therefore, this is another example wherein an upper-band portion of an original audio stream is being coded, i.e. the LPC coefficients and the gain, whereas a narrowband portion of the original audio stream is not coded. The combination of coded and uncoded portions of the audio stream is transmitted and then received in such a way as to decode the portions that require decoding.

In addition to saving bits during transmission, this method has another advantage: it does not need any explicit voiced/unvoiced decision and control as G.729 or any other vocoder does, because the excitation (LPC residue) derived at the receiver will automatically be periodic like when the received NB signal is voiced, and white-noise like when the signal is unvoiced. Thus, the encoding/decoding scheme according to an embodiment of the present invention for the upper-band is much simpler than a vocoder. As a result, the upper-band signal can be coded with no more than 18+5=23 bits per 80-sample frame, or 0.29 bit per NB data sample.

Different applications of embodiments of the present invention will now be discussed in relation to two classes of concurrent services and bandwidth extension. In terms of concurrent services, with embodiments of the present invention implemented in customers' terminals and in service providers' equipment, a hidden communications sub-channel can be established between users in those two groups. They can then exchange information without interrupting or degrading the voice communications. Some examples of such information exchange for concurrent services are as follows.

Instant CLID—The caller's identity, such as name and phone number, is sent simultaneously with the very first ringing signal, so that the called party can immediately know who the caller is, instead of having to wait until after the end of the first ringing as per the current technology.

Non-interruption call waiting—While on the phone, a user can get a message showing that a third party is calling and probably the identity of the third party, without having to hear a beep that interrupts the incoming voice.

Concurrent text message—While on the phone talking to each other, two parties can simultaneously exchange text messages, such as e-mail and web addresses, spelling of strange names or words, phone numbers, . . . , which come up as needed in the conversation. For this application, the phones need to be equipped with a keypad or keyboard as well as a display unit.

Simultaneous "display-based interactive services" and voice. "Display-based interactive services" is a feature supported on some products, so that the user can use the phone to access services like whether forecast, stock quotes, ticket booking, etc., and the results can be displayed on the phone's screen. Currently, these non-voice services and voice are mutually exclusive, i.e., no voice communication is possible during the use of any of these services. With the invention, these services can be accessed concurrently with voice. For example, while a client and a company receptionist carry on a conversation, the latter can send the former certain written information, such as text messages, on the fly.

In fact, the list for such concurrent services is endless, and it is up to service providers and system developers to explore the possibilities in this class of applications. The invention just opens up a sub-channel for them to implement the features they can think of. This sub-channel is compatible with the existing NB infrastructure, e.g., PSTN, digital PBX, and VoIP. This sub-channel co-exists with audio. This sub-channel does not degrade audio quality, and this sub-channel is hidden for a POTS user.

There are also concurrent services that can be provided in a situation where the audio stream is not a traditional speech or telephony stream. For instance, additional information can be embedded in a hidden sub-channel, substantially below a perceptual mask, of a broadcast signal in order to embed additional information therein. As such, information regarding a song being played on a radio station, about a guest on a talk radio show, or even traffic information could be embedded in the broadcast signal for interpretation and display on a capable enhanced receiver, without affecting the sound quality received by listeners who have a traditional receiver not able to make use of the concurrent services.

A further example is the embedding of additional information in a track of an audio compact disc (CD). Song information, such as lyrics and/or artist and title information, can be displayed while a song is being played on a receiver, in this case an enhanced CD player, capable of interpreting the embedded information in the hidden sub-channel of the audio stream on the CD track. In fact, display of the lyrics in time with the song could easily add a "karaoke"-like feature to an audio stream on a CD, or DVD or similar medium on which an audio stream is stored and from which it is played back. All of this is done in a way that does not interfere with the sound quality for those listeners who do not have the ability to take advantage of the concurrent services.

With this application, the invention can be implemented either as firmware on a computer readable memory, such as a DSP, residing in the phone terminal, or as an adjunct box that contains a mini DSP system and user interface (keypad/keyboard and display), and is attached to a phone terminal through the loop (tip and ring) or handset/headset interface.

Figure 8:
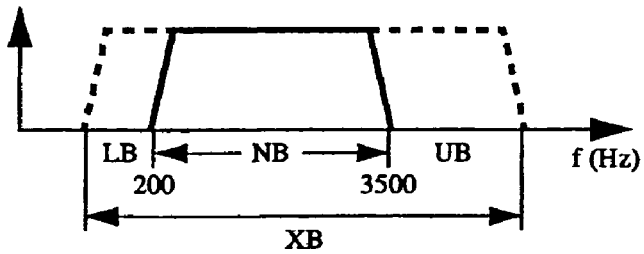
FIG. 8 is an illustration of the extension of an NB channel to an XB channel according to an embodiment of the present invention.

It is well known that a bandwidth extension beyond that of conventional NB (200-3500 Hz) telephony can result in significant improvements in audio quality and intelligibility. FIG. 8 illustrates the concept of bandwidth extension, from NB to an extended band (XB). In the figure, "lower band" (LB) stands for part of the XB that is below NB, and "upper band" (UB) the XB part above NB. In addition, LB and UB will be denoted as LUB. Note that the term "extended band" (XB) is being used rather than the well-known term "wide band" (WB). This is because WB commonly refers to a fixed bandwidth of 50-7000 Hz in the telecom industry. The scheme discussed presently extends the bandwidth in a dynamic fashion; the resultant bandwidth is time variant instead of being fixed. XB is a term used herein when addressing the bandwidth extension application of embodiments of the invention.

Since an NB channel's physical bandwidth cannot be extended, the possibility of using embodiments of the present invention to embed the LB and UB information into the NB signal at the transmitter and to restore it at the receiver was investigated. This way, the signal that is transmitted over the NB channel is NB physically, sounds the same as a conventional NB signal to a POTS user, and contains the information about LB and UB.

There are existing "audio bandwidth extension" algorithms that derive or extrapolate, components that are beyond the NB range based only on the information available within NB. However, existing techniques have their limitations because of the lack of information, and are only applicable to speech signals. On the contrary, the current invention applied to this application is a scheme that embeds real LB and UB components into NB; therefore, it will not have such limitations and is applicable to speech as well as to audio in general. Furthermore, there are scalable speech and audio coders, which code the audio information out side of NB and restore it at the receiver. Being digital coding schemes, they transmit digital bits instead of analog waveforms, and therefore are different from the current invention applied to the bandwidth extension application.

Figure 9:
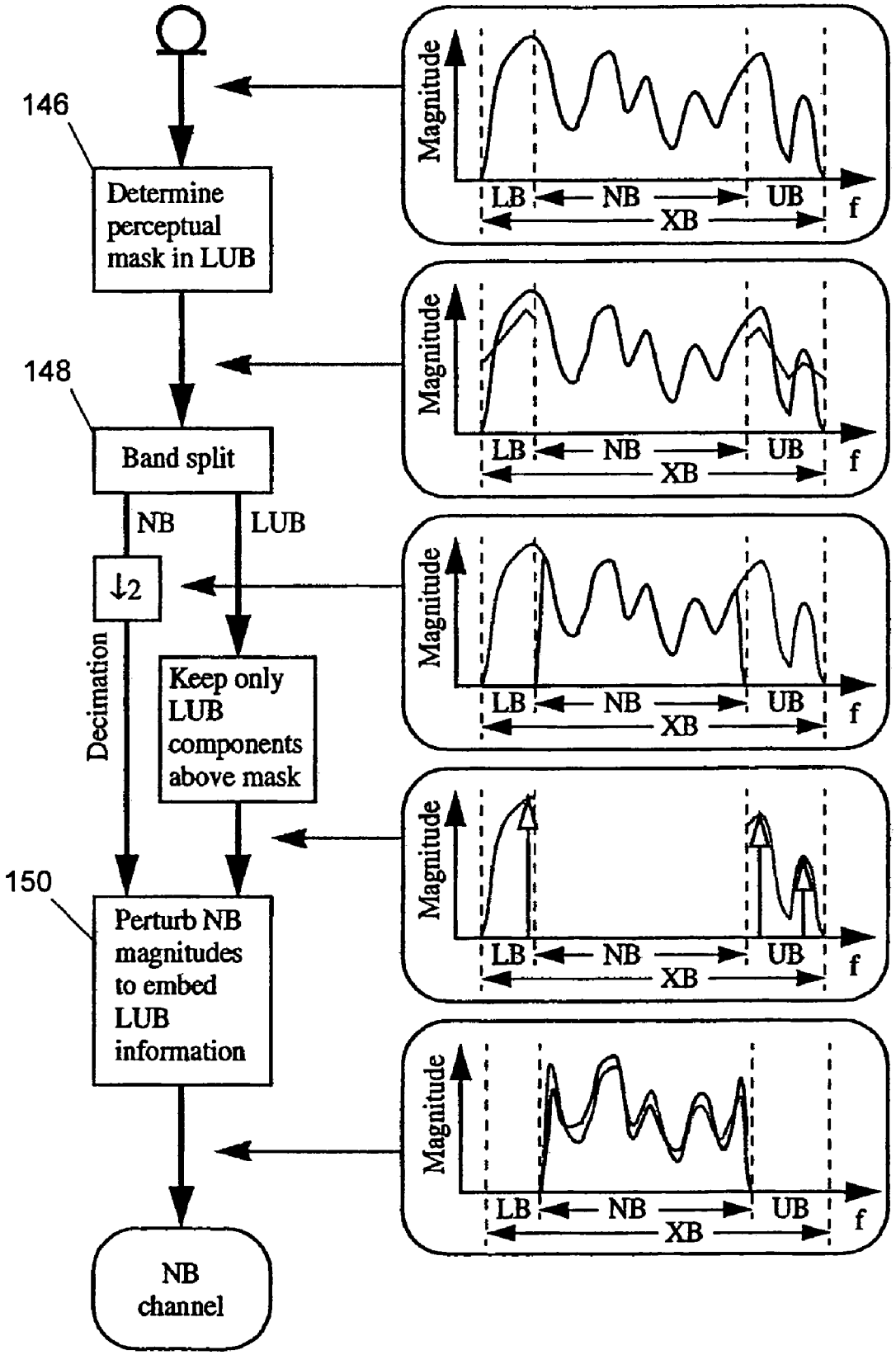
FIG. 9 illustrates a flow diagram and audio stream frequency representations for a transmitter which implements the magnitude perturbation scheme according to an embodiment of the present invention.
Figure 10:
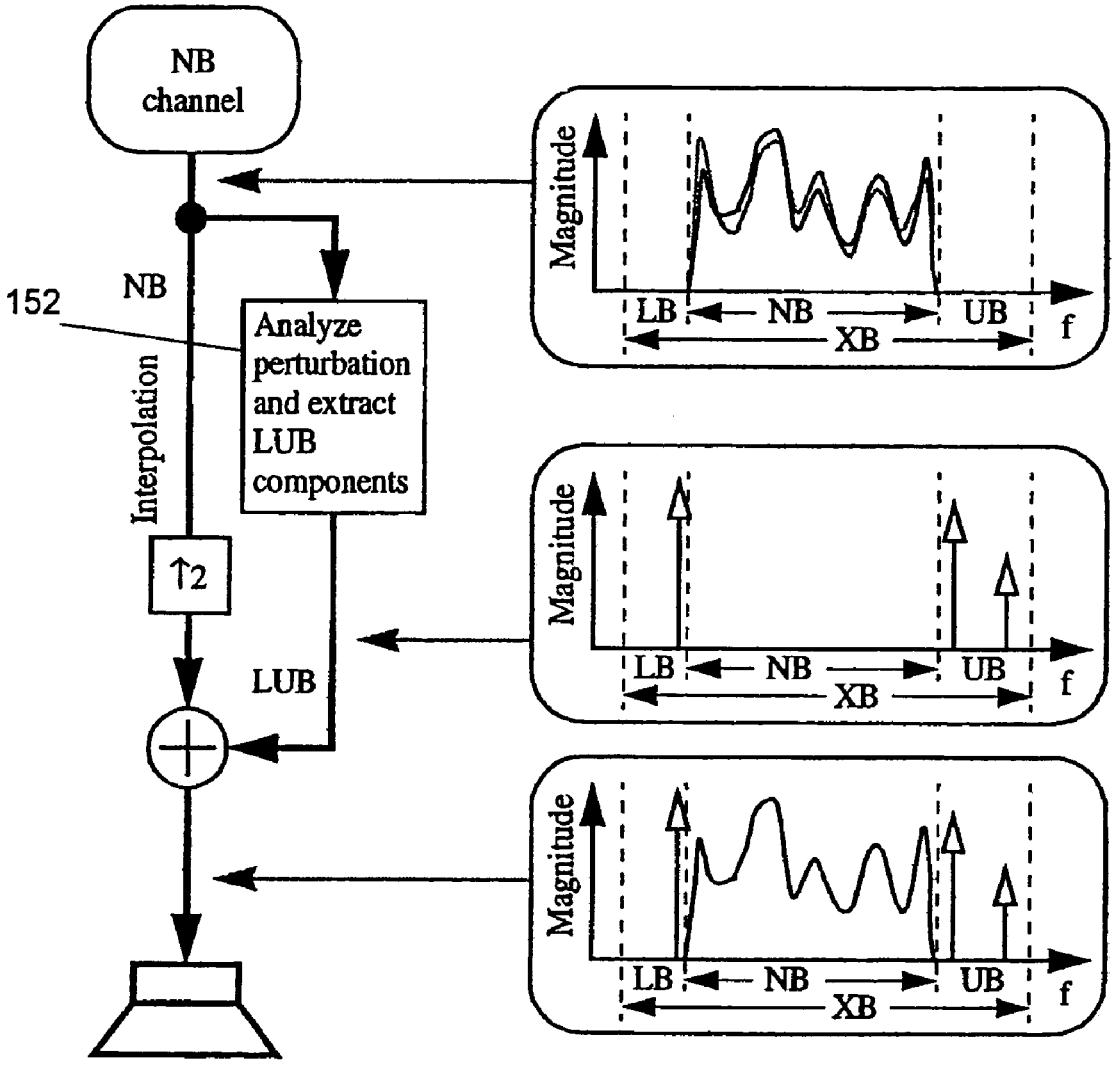
FIG. 10 illustrates a flow diagram and audio stream frequency representations for a receiver which implements the magnitude perturbation scheme according to an embodiment of the present invention.

An example of the bandwidth extension application is now illustrated, where the MP scheme is used to implement the application. Flow diagrams and audio stream frequency representations for activities at a transmitter and a receiver are shown in FIG. 9 and FIG. 10, respectively. With respect to the example illustrated in FIG. 9 relating to the transmitter, the MP transmitter partitions the original audio sequence, with a sampling rate of 16 kHz, into non-overlapped N-sample frames and processes them one after another. In this example, N=130 is chosen so that the frame size is 130/16=8 ms. It takes the following steps to process each frame.

1. Frame data analysis. The audio frame {x(n), n=0, 1, . . . , N−1} is transformed into the frequency domain by using the Fourier transform, and the magnitude of each frequency component is calculated. Note that a window function may be applied to the frame before the transform. This is formulated as $$X(k) = \sum_{n=0}^{N-1} w(n)x(n)e^{-j\frac{2\pi}{N}kn}, \quad k = 0, 1, \ldots, N-1 \tag{1}$$

$$A2(k) = X(k)X^*(k), \qquad k = 0, 1, \ldots, \frac{N}{2}$$

where "*" stands for the complex conjugate operation, {x(n), n=0, 1, . . . , N−1} is the data sequence in the frame, and {w(n), n=0, 1, . . . , N-1} is the window function, which can be, for example, a Hamming window $$w(n) = 0.54 - 0.46\cos\frac{2\pi n}{N-1}, n = 0, 1, \ldots, N-1 \tag{2}$$

Figure 11:
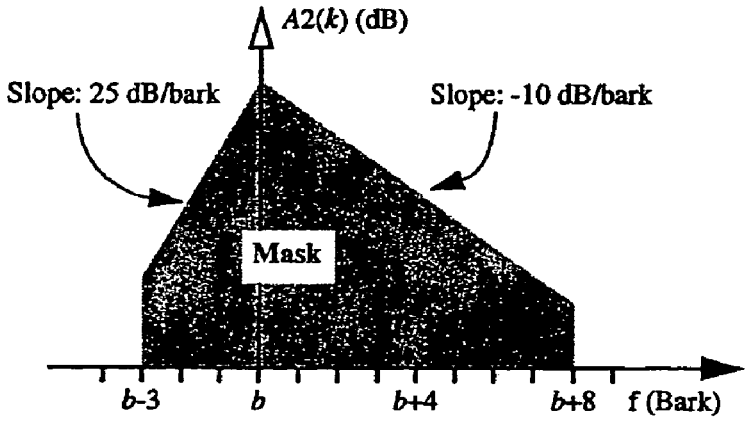
FIG. 11 is an illustration of an estimated perceptual mask according to an embodiment of the present invention contributed by a single tone.

2. Mask calculation. Based on {A2(k), k=0, 1, . . . , N/2} found in Eq. (1), two perceptual masks are calculated in step 146 for frequency bins that are in the LUB range, i.e., {∀k∈LUB}. They are (a) the NB mask {$M_{NB}$(k), ∀k∈LUB}, whose masking effects are contributed only by components in NB, i.e., by {A2(k), ∀k∈NB}, and (b) the global mask {$M_G$(k),∀k∈LUB}, with masking effects contributed by all components in XB (NB and LUB), i.e., by {A2(k),∀k∈XB}. Since NB is a sub-set of XB, the calculation for the latter mask can start with the former. Although the masks could be calculated by using a more complicated way, a much simpler approach has been employed, where each individual component A2(k) (k in NB for $M_{NB}$ calculation, and k in XB for $M_G$ calculation), in a certain critical band b, provides an umbrella-like mask that spreads to three critical bands below and eight critical bands up, as shown in FIG. 11.

A warped version of the linear frequency (Hz) scale, the "Bark" scale divides the entire audible frequency band into twenty five critical bands. Such a somewhat logarithmic-like scale is deemed to better reflect the resolution of the human auditory system (HAS). The calculation model shown in FIG. 11 is derived from the discussions in those papers.

Figure 12:
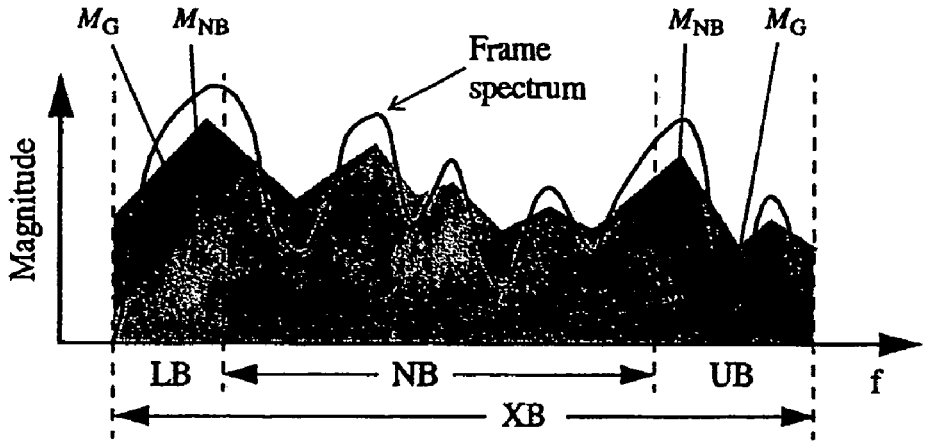
FIG. 12 is an illustration of two estimated perceptual masks according to an embodiment of the present invention, which are contributed by audio signal components in NB and XB, respectively.

In LUB, the sum of masks contributed by all {A2(k), ∀k∈NB} and the absolute hearing threshold forms the NB mask $M_{NB}$. Again in LUB, the sum of $M_{NB}$ and masks contributed by all {A2(k), ∀k∈LUB} forms the global mask $M_G$. Obviously, these summation operations have to be done in the linear domain, as opposed to dB. FIG. 12 shows an example of what the two masks, $M_{NB}$ and $M_G$, found in this step may look like, given a certain spectrum shape. Note that in FIG. 12, the two masks also have definitions in NB. This is provided for illustration purposes; only their values in LUB will be used in the method.

3. Retention determination. Based on signal to global mask ratio, denoted as SGMR and calculated by:

$$SGMR(k) = 10 \cdot \log\frac{A2(k)}{M_G(k)}, \forall k \in LUB \tag{3}$$

It remains to be determined which components in LUB are to be kept, i.e., ones that will be encoded into the perturbations for transmission to the receiver. One method is to keep all LB components and up to $N_R$, a pre-specified retention number, of UB components with SGMR>0 dB. If number of UB components with SGMR>0 dB is less than or equal to $N_R$, all those components will be retained. However if number of UB components with SGMR>0 dB is greater than $N_R$, only $N_R$ such components with the largest SGMRs will be kept. Next, SNMRs, signal to NB mask ratios for to-be-retained components, are found as $$SNMR(k) = 10 \cdot \log\frac{A2(k)}{M_{NB}(k)}, \forall k \in \{LUB \cap \text{to-be-retained}\} \tag{4}$$

4. At this point, an NB signal is derived from the original input {x(n), n=0, 1, . . . , N−1} (in step 148) by using a band-pass filter. Perturbation discussed next will be applied to this NB signal in the frequency domain to constitute the transmitter's output. Since the bandwidth of this NB signal is limited to NB, it is decimated by two so that the sampling rate reduces to 8 kHz—being compatible with that used in PSTN, digital PBX, and VoIP systems. This 8 kHz sampled sequence is expressed as $$x_{NB}(n), n = 0, 1, \ldots, \frac{N}{2} - 1 \tag{5}$$

whose Fourier transform, which is N/2-point, is $$X_{NB}(k) = \sum_{n=0}^{\frac{N}{2}-1} x_{NB}(n)e^{-j\frac{4\pi}{N}kn}, k = 0, 1, \ldots, \frac{N}{2} - 1 \tag{6}$$

5. Perturbation vector determination. The perturbation vector {P(k), k=0, 1, . . . , N/4} has the same number of elements as number of independent frequency bins in NB. Each element P(k) of the perturbation vector is a number in the vicinity of unity, corresponds to a signal component in a certain frequency bin in NB, and acts as a scaling factor for that component. If there is no need to perturb a certain NB signal component, the P(k) corresponding to that component will be unity.

The magnitude and the sign of each deviation, i.e., P(k)-1, are determined as per the LUB components to be embedded.

While there are various ways of doing this, one method is described herein. This method is based on the understanding that the phases of the components in LB matters subjectively while that of the components in UB don't. In this example, the chosen parameters are, frame length N=130, XB: 125 Hz-5500 Hz, and NB: 250 Hz-3500 Hz. These, together with the fact that the sampling rate for the input audio sequence is 16 kHz, result in a perturbation vector with 27 elements that can deviate from unity, and a frequency bin allocation map in Table 1 below:

TABLE 1

| Bin Number | Center frequency (Hz) | Band |
|---|---|---|
| 0 | 0 | Out of XB |
| 1 | 125 | LB |
| 2-28 | 250-3500 | NB XB |
| 29-44 | 3625-5500 | UB |
| 45-64 | 5625-8000 | Out of XB |

Table 1 indicates that there is only one component in LB. Frequency bins 2 through 7, in NB, are allocated to bear the information about this LB component. The six perturbing values, for those six bins respectively, are therefore reflected in {P(k), k=2, 3, . . . , 7}, respectively. In particular, $\delta_{LB}$, the absolute deviation of all the six elements from unity, is used to represent SNMR(1) (LB), found in Eq. (4), and the polarities of these deviations are used to represent the phase word for the LB component. The phase word is a two's complement 6-bit binary word that has a range of −32 to +31, which linearly partitions the phase range of [−π, π). If SGMR(1) [Eq. (3)] is negative, meaning that the LB component is below the perceptual threshold, there is no need to embed the LB component so that $\delta_{LB}$ can be set to 0. Otherwise, $\delta_{LB}$ can range from a minimum of $\delta_{min}$ to a maximum of $\delta_{max}$, and SNMR(1), in dB, is scaled down and linearly mapped to this range. For example, $\delta_{LB}=\delta_{min}$ means that SGMR(1) is just above 0 dB, $\delta_{LB}=\delta_{max}$ represents that SGMR(1) equals SNMRmax, a pre-determined SNMR's upper limit that can be accommodated, being 50 dB in the prototype, and $\delta_{LB}=(\delta_{max}+\delta_{min})/2$ stands for the fact that SGMR(1) is half that maximum value, or 25 dB in this case. Note that $\delta_{LB}$ will be upper-limited at $\delta_{max}$ even if SGMR(1) exceeds SNMRmax. The determination of $\delta_{LB}$ can be summarized as $$\delta_{LB} = (\delta_{\max} - \delta_{\min})\frac{\mathrm{Min}[SNMR(1), SNMR_{\max}]}{SNMR_{\max}} + \delta_{\min} \tag{7}$$

$$\delta_{\max} = 10^{(0.66\mathrm{dB})/20} - 1$$

$$\delta_{\min} = 10^{(0.2\mathrm{dB})/20} - 1$$

$$SNMR_{\max} = 50(\mathrm{dB})$$

The coding of the phase word is summarized in Table 2.

TABLE 2

| NB bin number | Center frequency (Hz) | Bit # of phase word (PW) | Perturbation Vector k | Perturbation Vector P(k) |
|---|---|---|---|---|
| 2 | 250 | 0 | 2 | $1 + \delta_{LB}$ |
| 3 | 375 | 1 | 3 | if PW bit = 1 |
| 4 | 500 | 2 | 4 | $1 - \delta_{LB}$ |
| 5 | 625 | 3 | 5 | if PW bit = 0 |

TABLE 2-continued

| NB bin number | Center frequency (Hz) | Bit # of phase word (PW) | Perturbation Vector k | Perturbation Vector P(k) |
|---|---|---|---|---|
| 6 | 750 | 4 | 6 | |
| 7 | 875 | 5 | 7 | |

For example, if the six elements P(2), P(3), . . . , and P(7) of the perturbation vector are [1.06, 0.94, 0.94, 1.06, 0.94, 1.06], respectively, then the phase word is $$PW=101001(\text{binary})=-23(\text{decimal}) \tag{8}$$

which stands for a phase value of $$\phi_{LB} = -\frac{23}{32}\pi \tag{9}$$

Furthermore, these six elements of the perturbation vector give a $\delta_{LB}$ of 0.06, which means, from Eq. (7)

$$\begin{aligned} SNMR(1) &= \frac{\delta_{LB} - \delta_{\min}}{\delta_{\max} - \delta_{\min}} SNMR_{\max} \\ &= \frac{0.06 - 10^{0.2/20} + 1}{10^{0.66/20} - 10^{0.2/20}} \cdot 50 = 33.0(\mathrm{dB}) \end{aligned} \tag{10}$$

The reason why multiple bins are used to encode a single $\delta_{LB}$ is for the receiver to average out the potential noise associated with individual bins. This will be discussed further when the receiver is studied.

A discussion of how to embed the UB components follows. There are sixteen UB components of which up to $N_R$ will be retained to be embedded. The way of encoding the information about these components into the perturbation vector for NB components is done in a manner similar to that for the LB component. However, it is no longer necessary to encode the phase information as it is subjectively irrelevant in the UB. Instead, the destination bin information, which specifies which frequency bin each embedded component belongs to, needs to be encoded, in order for the receiver to place them in the right frequency bins.

In this example, $N_R=3$ is chosen. The allocation of the NB frequency bins to embed the three UB components is shown in Table 3, which shows a perturbation vector for UB components.

TABLE 3

| NB bin number | Center frequency (Hz) | Bit # of offset word, for destination | UB component | Perturbation vector k | Perturbation vector P(k) |
|---|---|---|---|---|---|
| 8 | 1000 | 3 | SGMR(UB1), | 8 | 1 + |
| 9 | 1125 | | the one with | 9 | $\delta_{LB}$ if |
| 10 | 1250 | 2 | largest | 10 | bit = 1 |
| 11 | 1375 | | SGMR in UB | 11 | 1 − |
| 12 | 1520 | 1 | | 12 | $\delta_{LB}$ if |
| 13 | 1625 | | | 13 | bit = 0 |
| 14 | 1750 | 0 | | 14 | |
| 15 | 1875 | 3 | SGMR(UB2), | 15 | 1 + |

TABLE 3-continued

| NB bin number | Center frequency (Hz) | Bit # of offset word, for destination | UB component | Perturbation vector k | Perturbation vector P(k) |
|---|---|---|---|---|---|
| 16 | 2000 | | the one with | 16 | $\delta_{LB}$ if |
| 17 | 2125 | 2 | second | 17 | bit = 1 |
| 18 | 2250 | | largest | 18 | 1 − |
| 19 | 2375 | 1 | SGMR in UB | 19 | $\delta_{LB}$ if |
| 20 | 2500 | | | 20 | bit = 0 |
| 21 | 2625 | 0 | | 21 | |
| 22 | 2750 | 3 | SGMR(UB3), | 22 | 1 + |
| 23 | 2875 | | the one with | 23 | $\delta_{LB}$ if |
| 24 | 3000 | 2 | third largest | 24 | bit = 1 |
| 25 | 3125 | | SGMR in UB | 25 | 1 − |
| 26 | 3250 | 1 | | 26 | $\delta_{LB}$ if |
| 27 | 3375 | | | 27 | bit = 0 |
| 28 | 3500 | 0 | | 28 | |

Note that UB1, UB2 and UB3 are numbers of frequency bins in UB, i.e., (UB1, UB2, UB3 ∈UB). $\delta_{UBi}$ (i=1, 2, 3) in these perturbation vector elements has the same meaning as $\delta_{LB}$ in the LB case above. For example, $\delta_{UB1}$ in the perturbation vector elements corresponding to bins 8-14 is a scaled version of SNMR(UB1), of the UB component with the largest SGMR there. $\delta_{UBi}$ (i=1, 2, 3) are determined by $$\delta_{UBi} = (\delta_{\max} - \delta_{\min})\frac{\mathrm{Min}[SNMR(UBi), SNMR_{\max}]}{SNMR_{\max}} + \delta_{\min} \quad (11)$$

$$i = 1, 2, 3$$

$$\delta_{\max} = 10^{(0.66\mathrm{dB})/20} - 1$$

$$\delta_{\min} = 10^{(0.2\mathrm{dB})/20} - 1$$

$$SNMR_{\max} = 50(\mathrm{dB})$$

For each UB component that is embedded, there is a four-bit "destination bin number offset word", as shown in Table 3. This word is determined by $$(\text{Offset word})_i = UB_i - 29,\ i = 1,2,3 \quad (12)$$

By looking at Table 1 one can see that a "destination bin number offset word" can range from 0 to 15, i.e., four bits are needed to represent the location of a UB component, in bins 29-44, or 3625-5500 Hz.

Note that the selection of $N_R$=3 in the prototype is just for verification purposes. $N_R$ can be increased to 4 or 5, so as to embed more UB components to improve the audio quality at the receiver, without major changes to the method described above. This can be understood by looking at Table 3, where it can be seen that seven NB bins are used to code a four-bit "destination bin number offset word". The redundancies can be reduced to free up more capacity. In the meantime, some intelligence may need to be built into the receiver to compensate for the potentially increased error rate.

6. In this last step 150 (in FIG. 9) of the transmitter, elements of the perturbation vector found above are multiplied with the components in NB and the resultant NB spectrum is inversely transformed back to the time domain as the following $$y(n) = \frac{2}{N}\sum_{k=0}^{\frac{N}{2}-1} Y(k)e^{j\frac{4\pi}{N}nk},\quad n = 0, 1, \ldots, \frac{N}{2} - 1 = 63 \quad (13)$$

where $$Y(k) = \begin{cases} X_{NB}(k), & 0 \le k \le 1 \\ X_{NB}(k)P(k), & 2 \le k \le 28 \\ X_{NB}(k), & 29 \le k \le \frac{N}{4} - 1 = 31 \\ Y^*\left(\frac{N}{2} - k\right), & \frac{N}{4} < k \le \frac{N}{2} - 1 = 63 \end{cases} \quad (14)$$

and $\{X_{NB}(k), k=0, 1, \ldots, N/4\}$ are from Eq. (6), and $\{P(k), k=2, 3, \ldots, 28\}$ are elements of the perturbation vector given in Table 2 and Table 3. Note that the length on the inverse transform here is N/2, half of that with the forward transform Eq. (1). This is because the sampling rate has been halved. to 8 kHz. These operations are done on a frame by frame basis and the resultant consecutive frames of $\{y(n), n\in[0,N/2-1]\}$ are concatenated without overlap, to form an 8 kHz time sequence to be sent to the receiver.

7. During transmission, the signal sequence, or audio stream, is sent through an audio channel, such as that with a digital PBX, the PSTN, or VoIP, to the remote receiver. If PSTN is the media, there may be channel degradations, such as parasitic or intentional filtering and additive noise, taking place along the way.

8. A POTS will treat the received signal as an ordinary audio signal and send it to its electro-acoustic transducer such as a handset receiver or a hands free loudspeaker. Since the changes made by the MP operations are under the perceptual threshold, they will not be audible to the listener.

9. At a receiver equipped with the MP scheme. If the transmission channel contains analog elements, such as the PSTN, the received time sequence may need to undergo some sort of equalization in order to reduce or eliminate the channel dispersion. The equalizer should generally be adaptive in order to be able to automatically identify the channel characteristics and track drifts in them. Again, the subject of channel equalization is beyond the scope of this invention and therefore will not be further discussed here.

10. Frame data analysis (step 152 in FIG. 10). The 8 kHz time sequence is then partitioned into frames, and each frame is transformed into the frequency domain by using the Fourier transform, and the magnitude of each frequency component is calculated. Note that a window function may be applied to the frame before the transform. This is formulated as $$X(k) = \sum_{n=0}^{\frac{N}{2}-1} w(n)x(n)e^{-j\frac{4\pi}{N}kn} \quad k = 0, 1, \ldots, \frac{N}{2} - 1 \quad (15)$$

$$A2(k) = X(k)X^*(k), \qquad k = 0, 1, \ldots, \frac{N}{4}$$

where "i" stands for the complex conjugate operation, $\{x(n), n=0, 1, \ldots, N/2-1\}$ is the data sequence in the frame, and $\{w(n), n=0, 1, \ldots, N/2-1\}$ is the window function, which for example can be a Hamming window $$w(n) = 0.54 - 0.46\cos\frac{4\pi n}{N-2}, \quad n = 0, 1, \ldots, \frac{N}{2} - 1 \tag{16}$$

Note that Eqs. (15) and (16) are similar to their counterparts in the transmitter, i.e., Eqs. (1) and (2), except that N there has now been replaced by N/2 here. This is because here the sampling rate of {x(n)} is 8 kHz, half of that with Eqs. (1) and (2).

Figure 13:
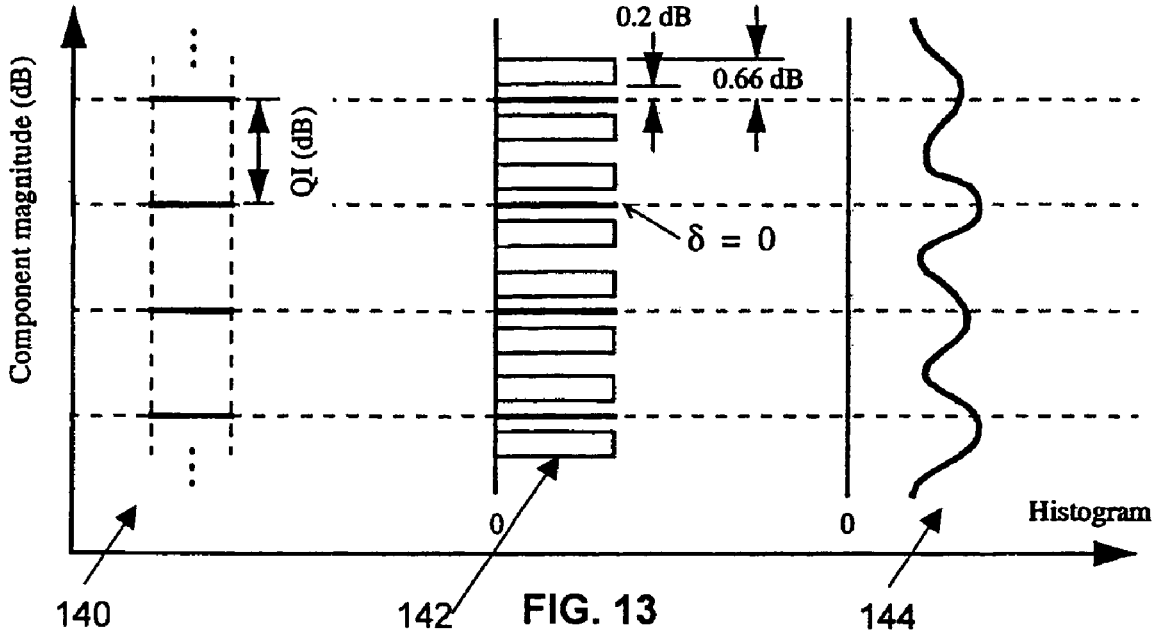
FIG. 13 is a more detailed illustration of the criterion for correct frame alignment shown in FIG. 7.

11. The frame boundary positions are determined by using an adaptive phase locking mechanism, in an attempt to align the frames assumed by the receiver with those asserted by the transmitter. The criterion to judge a correct alignment is that the distributions of {A2(k), ∀k∈NB} in each frame exhibit a neat and tidy pattern as opposed to being spread out. This is illustrated in FIG. 13, where the quantitative dB values are a result of Eq. (7) and Eq. (11). With the frame alignment achieved, the position of the equilibrium QG for each frequency bin can be readily determined by examining the histogram of the magnitude over a relatively large, number of past frames, as shown in FIG. 13.

12. With the above done, each element of the perturbation vector, which the transmitter applied to a certain NB component, can be retrieved as the offset of the magnitude of the component from the nearest level in its corresponding equilibrium QG. For noise immunity purpose, any such offset less than 0.2 dB will be regarded as invalid.

Figure 14:
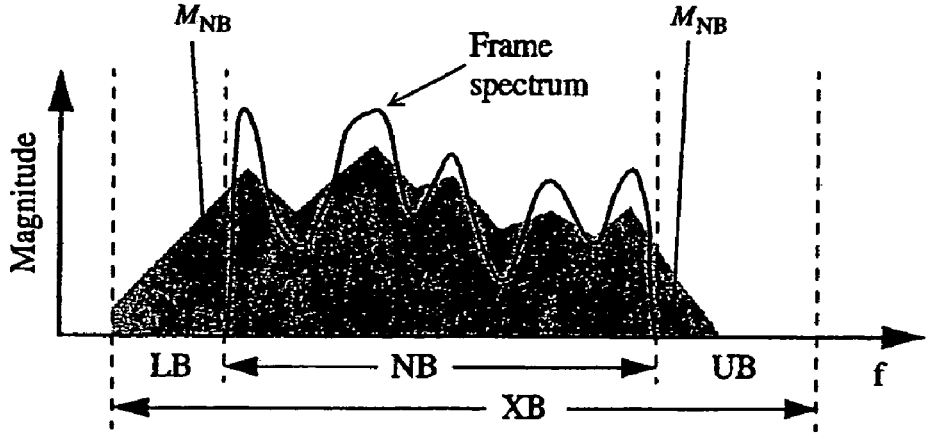
FIG. 14 is an illustration of an estimated perceptual mask according to an embodiment of the present invention for an audio signal in an NB channel, this mask only having contribution from NB signal components.

13. Based on {A2(k), k∈NB} found in Eq. (15), the NB perceptual mask $\{M_{NB}(k), k\in LUB\}$ is calculated for frequency bins that are in the LUB range. Note that the masking effects of $M_{NB}$ are contributed only by components in NB, i.e., by {A2(k), k∈NB}. $M_{NB}$ should be calculated by using the same method as that used in the transmitter, i.e., Step 2. The resultant $M_{NB}$ may look like the one illustrated in FIG. 14. Note that in FIG. 14, $M_{NB}$ also has definitions in NB. This is for illustration purposes only; only its values in LUB are needed in the algorithm.

14. At this point, the sampling rate of the received NB signal is doubled, to 16 kHz, in order to accommodate the UB components to be restored. This is done by inserting a zero between every adjacent pair of the received 8 kHz samples and performing a 16 kHz low-pass filtering, with a cut-off frequency at around 4 kHz, on the modified sequence. The resultant sequence will be referred to as $\{y_{NB}(n), n=0, 1, \ldots, N-1\}$ in the sequel, i.e., in Eq. (27).

15. Parameter restoration. The retrieved perturbation vector tells the magnitude and the polarity of the deviation applied to each NB component. Thus, the underlying parameters can be restored as follows.

From Eq. (7), SNMR(1), for the LB component, is found by using $$SNMR(1) = \frac{\overline{\delta_{LB}} - \delta_{\min}}{\delta_{\max} - \delta_{\min}} SNMR_{\max} \tag{17}$$

where the constants are defined in Eq. (7), and $\overline{\delta_{LB}}$ is a weighted average of the absolute values of the perturbation deviations in frequency bins 2-7 (Table 2). $\overline{\delta_{LB}}$ is calculated as $$\overline{\delta_{LB}} = \frac{\sum_{k=2}^{7} |X(k)| \cdot \delta_{LB}(k)}{\sum_{k=2}^{7} |X(k)|} \tag{18}$$

where $\delta_{LB}(k)$ is the absolute deviation obtained from the perturbation vector element for frequency bin k. The weighting scheme in Eq. (18) is based on the understanding that $\delta_{LB}(k)$'s with larger magnitudes, whose corresponding component magnitudes are larger and therefore the noise is relatively smaller, are more "trust worthy" and deserve more emphasis. This strategy increases the receiver's immunity to noise.

The phase word PW, for the LB component, is restored and the actual phase $\phi_{LB}$ found by following Table 2 and Eqs. (8) and (9). From Eq. (11), SNMR(UBi) (i=1, 2, 3), for the 3 embedded UB components, are found by using $$SNMR(UBi) = \frac{\overline{\delta_{UBi}} - \delta_{\min}}{\delta_{\max} - \delta_{\min}} SNMR_{\max}, \quad i = 1, 2, 3 \tag{19}$$

where the constants are defined in Eq. (11), and is a weighted average of the absolute values of the perturbation deviations in corresponding frequency bins (Table 3). $\{\overline{\delta_{UBi}}\}$ are expressed as $$\overline{\delta_{UB1}} = \frac{\sum_{k=8}^{14} |X(k)| \cdot \delta_{UB1}(k)}{\sum_{k=8}^{14} |X(k)|} \tag{20}$$

$$\overline{\delta_{UB2}} = \frac{\sum_{k=15}^{21} |X(k)| \cdot \delta_{UB2}(k)}{\sum_{k=15}^{21} |X(k)|} \tag{21}$$

and $$\overline{\delta_{UB3}} = \frac{\sum_{k=22}^{28} |X(k)| \cdot \delta_{UB3}(k)}{\sum_{k=22}^{28} |X(k)|} \tag{22}$$

respectively. In the above equations, $\{\delta_{UBi}(k), i=1, 2, 3\}$ is the absolute deviation obtained from the perturbation vector element for frequency bin k. The weighting scheme used to increase the noise immunity has been discussed above.

The four-bit "destination bin number offset word", for each of the three UB components and as shown in Table 3, is retrieved by examining the polarities of the deviations in the corresponding seven-bin field. If a bit is represented by two deviations, the average of the two is taken into account. The actual bin number UBi of each UB component is determined according to Eq. (12), by $$UBi = (\text{Offset word})_i + 29, i = 1,2,3 \tag{23}$$

16. Now, all information has been gathered about the to-be-restored LUB components, including {SNMR(1), SNMR(UBi), i=1, 2, 3} for those components, NB perceptual mask $\{M_{NB}(k), k \in LUB\}$, $\phi_{LB}$, the phase of the LB component, and {UBi, i=1, 2, 3}, the destination bin numbers for the UB components. To restore them, an N-point inverse Fourier transform is perform as $$v_{LUB}(n) = \frac{1}{N}\sum_{k=0}^{N-1} V_{LUB}(k)e^{j\frac{2\pi}{N}nk}, \quad n = 0, 1, \ldots, N-1 \tag{24}$$

where $$|V_{LUB}(k)| = \begin{cases} 10^{\frac{M_{NB}(1)+SNMR(1)}{20}} & k \in LB(=1) \\ 0 & k \in NB \\ 10^{\frac{M_{NB}(UBi)+SNMR(UBi)}{20}} & k = UBi \in UB, \quad i = 1, 2, 3 \end{cases} \tag{25}$$

and $$\angle V_{LUB}(k) = \begin{cases} \phi_{LB} = \frac{PW \cdot \pi}{32} & k \in LB(=1) \\ 0 & k \in UB \end{cases} \tag{26}$$

Figure 15:
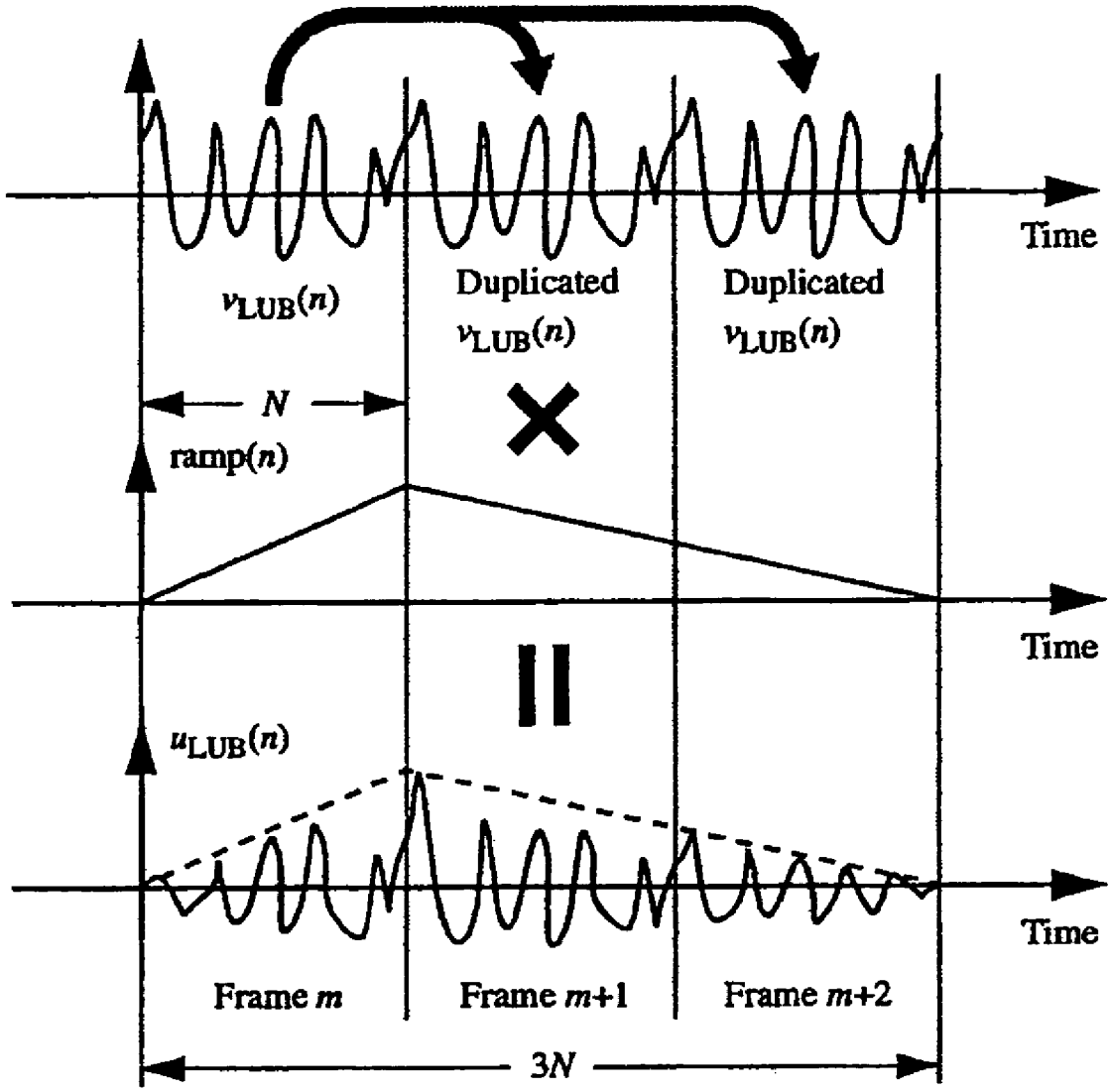
FIG. 15 is an illustration of ramping for a restored LUB time sequence according to an embodiment of the present invention.

Next, transition between adjacent frames of $\{V_{LUB}(n), n=0, 1, \ldots, N-1\}$ needs to be made smooth in order to minimize the audible artifacts if any. In this example, this is achieved by 1) the application of a ramping function to a sequence that is a repeated version of the $\{V_{LUB}(n), n=0, 1, \ldots, N-1\}$ in Eq. (24), then 2) the summation of such ramped sequences in consecutive frames. These two stages are described in detail below. A typical ramp function linearly ramps up from 0 to 1 in one frame (N=130 samples, with 16 kHz sampling rate) then linearly ramps down to 0 in two frames. Thus, the total ramp length is three frames. This operation is illustrated in FIG. 15, and the resultant sequence is referred to as $\{u_{LUB}(n), n=0, 1, \ldots, 3N-1\}$. Thus for each frame, a 16 kHz LUB time sequence is generated that ramps up in the current frame and ramps down in the next two frames. The sequence lasts for three consecutive frames, or 3N samples.

Figure 16:
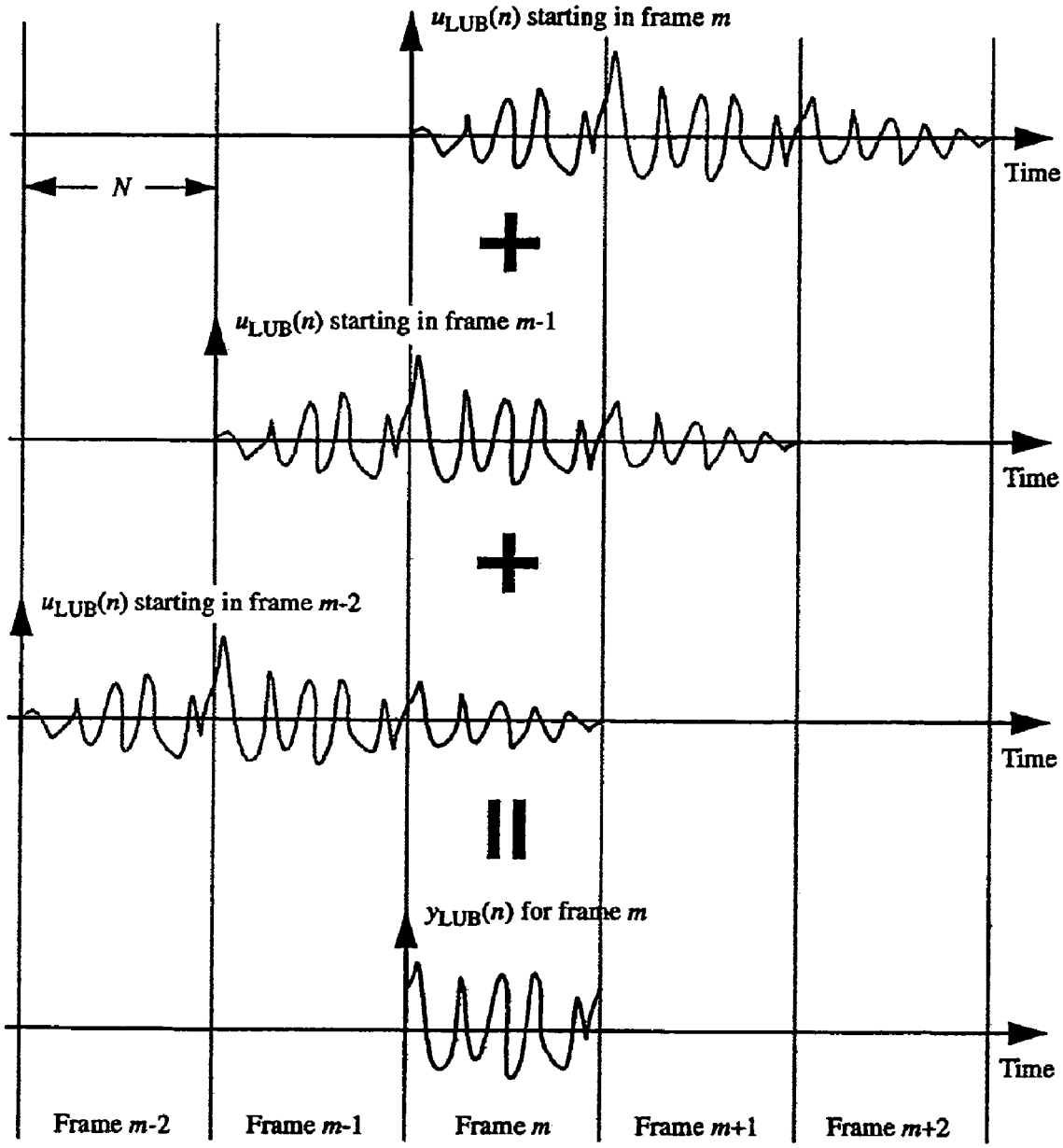
FIG. 16 is an illustration of the final forming of an LUB time sequence according to an embodiment of the present invention.

Next, all three such consecutive sequences $\{u_{LUB}(n), n=0, 1, \ldots, 3N-1\}$, starting in the current frame, the preceding one, and the one before the preceding one, respectively, are properly scaled and summed together to form $\{y_{LUB}(n), n=0, 1, \ldots, N-1\}$, the LUB output for the current frame, as shown in FIG. 16.

17. $\{y_{LUB}(n), n=0, 1, \ldots, N-1\}$ is then added to the NB input that has been up-sampled in Step 14. to constitute the final output {y(n), n=0, 1, . . . , N−1} of the receiver, as shown in Eq. (27) below.

$$y(n)=y_{NB}(n)+y_{LUB}(n), \; n=0,1, \ldots, N-1 \tag{27}$$

A specific example will now be discussed in relation to the bit manipulation (BM) implementation scheme. Although this particular example will illustrate the use of the previously-discussed coding scheme for audio stream communication, it is to be understood that the bit manipulation scheme can be implemented without this coding-assisted aspect. Therefore, the following example is more specifically directed to an embodiment using a coding-assisted bit manipulation implementation to achieve a bandwidth extension application.

The example provided below only considers extending the bandwidth of an NB channel at the high-end, i.e., beyond 3500 Hz. This is because the transmission at the low frequency end is usually not a problem in a digital network. The capacity that would otherwise be used for the low frequency components can therefore be used to transmit more high frequency components, so as to push the upper frequency limit higher, with a goal of reaching a scheme that supports true WB (50-7000 Hz).

Figure 17:
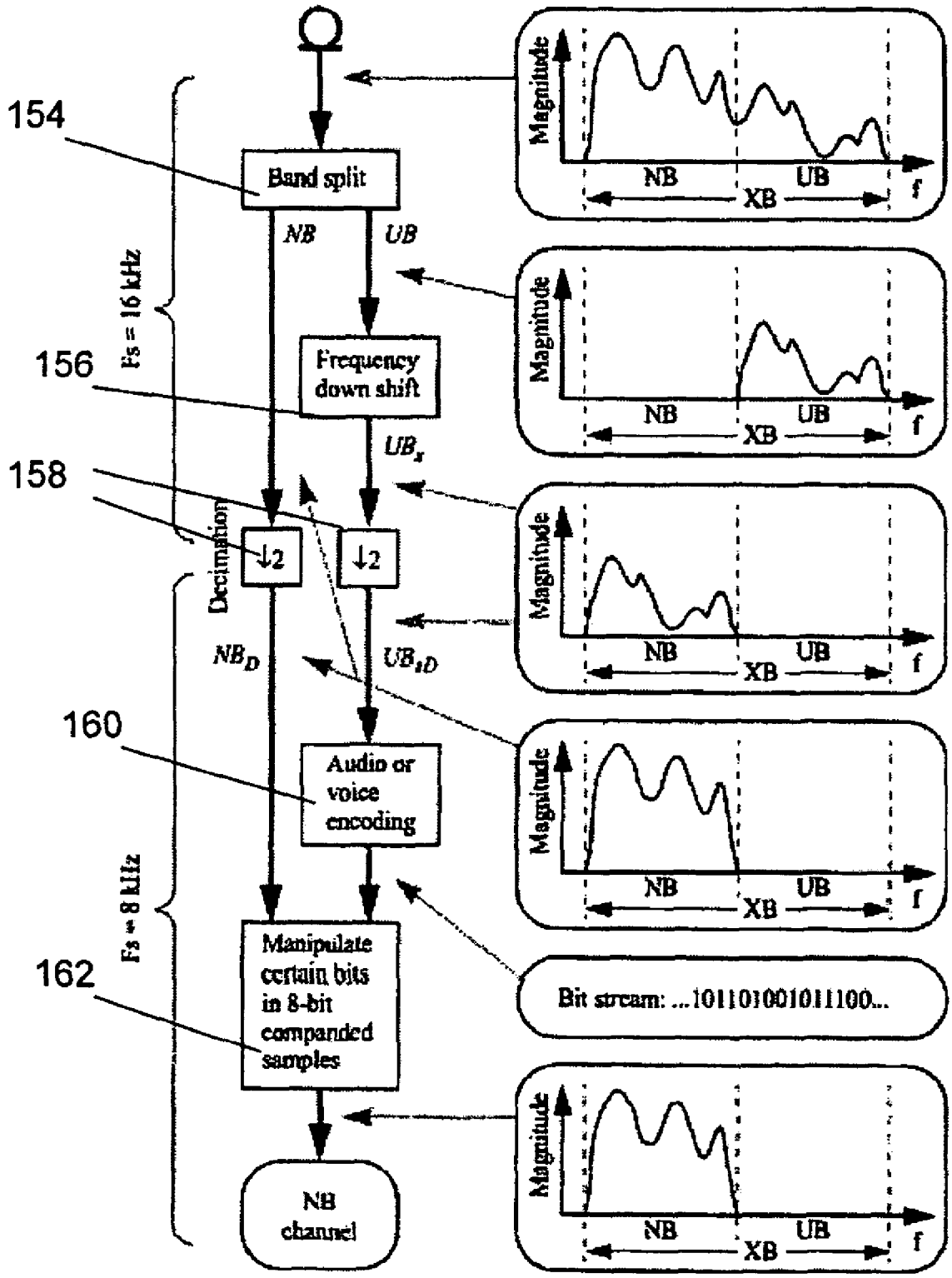
FIG. 17 illustrates a flow diagram and audio stream frequency representations for a transmitter which implements a coding-assisted bit manipulation scheme according to an embodiment of the present invention.
Figure 22:
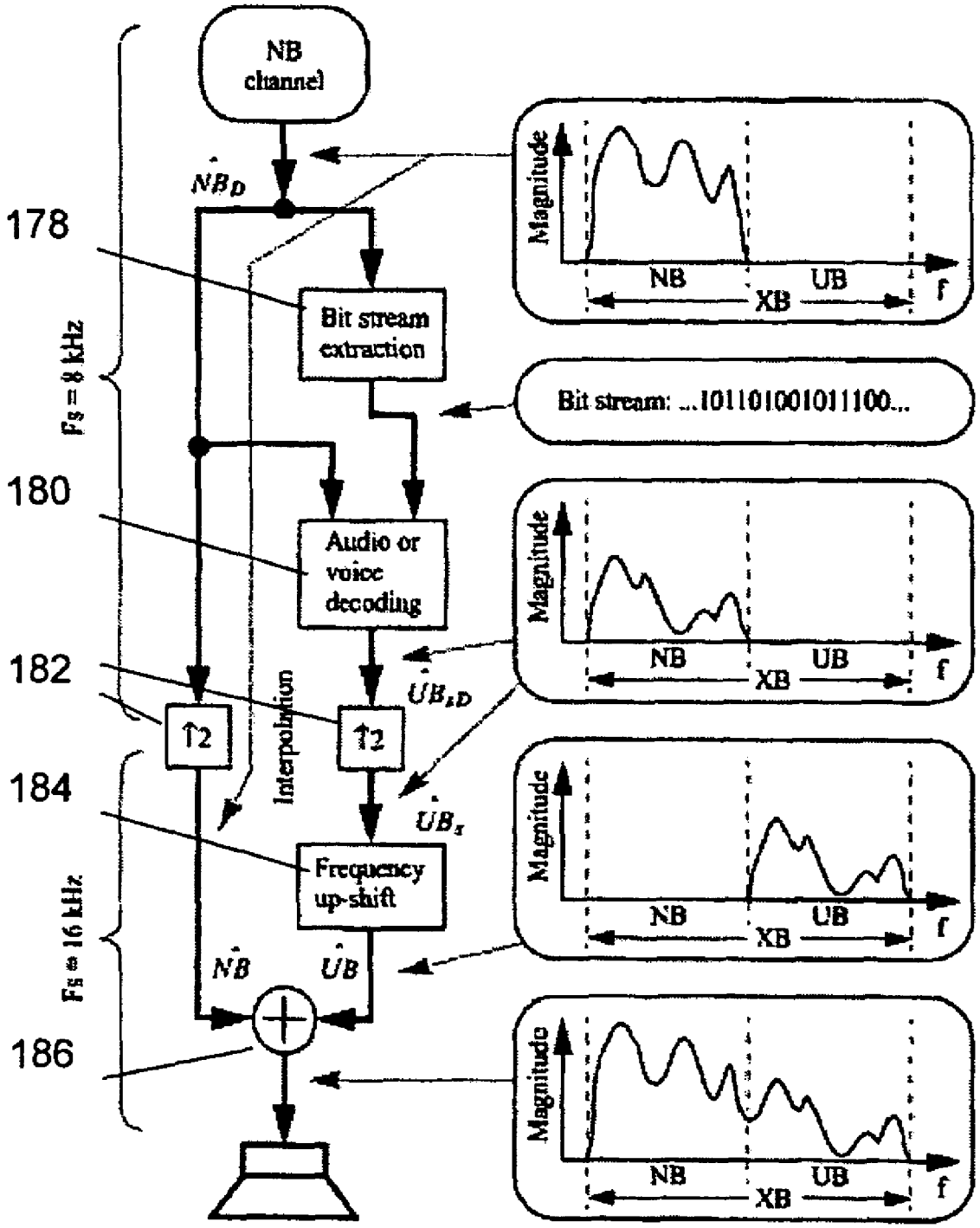
FIG. 22 illustrates a flow diagram and audio stream frequency representations for a receiver which implements a coding-assisted bit manipulation scheme according to an embodiment of the present invention.

The block diagrams of the coding-assisted (CA) BM transmitter and the receiver for audio bandwidth extension are in FIG. 17 and FIG. 22, respectively.

At the transmitter (FIG. 17) The transmitter partitions the original audio sequence, with a sampling rate of 16 kHz, into non-overlapped N-sample frames and processes them one after another. In this example, N=160 is chosen so that the frame size is 160/16000=0.01s=10 ms. It takes the following steps to process each frame.

1. Band split (154 in FIG. 17). The k-th (k=0, 1, 2, . . . ) frame of samples $\{x_k(n), n=0, 1, \ldots, N-1\}$ is filtered by two filters, being low-pass and high-pass which produce two outputs, NB and UB, respectively. In this example, the filter characteristics are shown in Table 4.

TABLE 4

| Filter | Output | Pass band (Hz) | Stop band (Hz) |
|---|---|---|---|
| Low pass | NB | 0-3400 | 3650-8000 |
| High pass | UB | 3460-8000 | 0-3290 |

2. UB frequency down-shift (156). The k-th frame UB output {UB(n), n=0, 1, . . . , N−1} of the band split step undergoes a frequency down-shift operation, by $F_{shift}$=3290 Hz in this example. The frequency down-shift operation consists of $$UB^1(n) = UB(n) \cdot \cos\left[\frac{2\pi F_{shift}}{16000}(kN+n)\right], \quad \forall n \in [0, N-1] \tag{28}$$

and the intermediate value $UB^I$ (n) in Eq. (28) being low-pass filtered to produce $UB_s$ (FIG. 17). For anti-aliasing purpose, the low-pass filter is preferably characterized as in Table 5.

TABLE 5

| Filter | Output | Pass band (Hz) | Stop band (Hz) |
|---|---|---|---|
| Low pass | $UB_S$ | 0-3710 | 3900-8000 |

As a result of this low-pass filtering, $UB_s$ contains few components over 3900 Hz.

3. Decimation for NB and $UB_s$ (158). Since both NB and $UB_s$ are band-limited to below 4000 Hz, they can be down-sampled, i.e., decimated, so that the sampling rate for them is halved, to 8000 Hz. This is achieved by simply taking every other sample of each of the two sequences, i.e.

$$NB_D(n) = NB(2n), \quad n = 0, 1, \ldots, \frac{N}{2}-1 \tag{29}$$
$$UB_{sD}(n) = UB_S(2n), \quad n = 0, 1, \ldots, \frac{N}{2}-1$$

4. Audio or voice encoding for $UB_{sD}$ (160). In this stage, the frequency-shifted and decimated version of the upper band signal $UB_{sD}$ is coded into digital bits. This can be done by the use of a standard encoding scheme or a part of it, as discussed earlier. In testing, two methods produced fairly good results. They are, respectively: the use of the upper-band portion of ITU-T G.722 voice encoder/decoder (codec); and the coding of linear predictive coding (LPC) coefficients and gain. They are discussed below.

Figure 18:
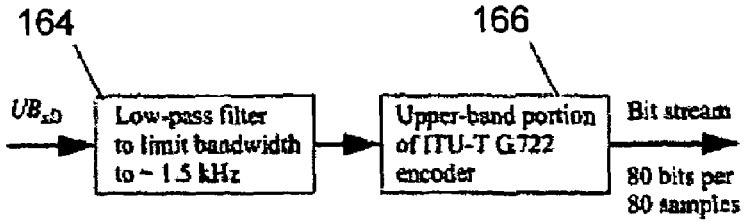
FIG. 18 illustrates a block diagram of an encoder for use with a coding-assisted bit manipulation scheme according to an embodiment of the present invention.

Use of upper-band portion of ITU-T G.722 voice codec. As discussed above, the upper-band portion of the G.722 codec can be used to code an upper-band of an original audio stream, whereas a narrowband portion of the original audio stream does not undergo any coding. The upper-band portion of the codec is used at a halved rate, i.e., 8 kbits/s, after $UB_{sD}$ has been further low-pass filtered so as to be band-limited to below 2 kHz and its sampling rate has been further reduced to 4 kHz. This way, an extra audio bandwidth of about 1.5 kHz can be transmitted by using 1 bit from each NB data word. This coding method can extend the upper limit of the audio bandwidth to around 5 kHz. Although good with the 16-bit linear data format, this method, modifying 1 bit every NB data sample, sometimes causes an audible noise with an 8-bit companded data format. A block diagram of the encoder is shown in FIG. 18. The decoder will be described later in relation to FIG. 23. Before moving on to a discussion of the encoder, a final note regarding FIG. 17 is that in step 162, certain bits are manipulated in 8-bit companded samples.

In FIG. 18, a low pass filter 164 is used to limit the bandwidth of the audio stream to approximately 1.5 kHz. After passing through the low pass filter 164, the audio stream passes through partial encoder 166, which encodes an upper-band portion of the audio stream. In this case, the partial encoder 166 implements the upper-band portion of the ITU-T G.722 encoder codec.

The second example of a coding scheme according to an embodiment of the present invention involves coding LPC coefficients and gain, using part of the ITU-T G.729 NB voice codec, as discussed above. A particular advantage of this embodiment of the present invention is the ability to only transmit the parameters for the LPC coefficients (18 bits required with G.729) and about 5 bits for the gain—totalling 18+5=23 bits, as opposed to 80, per frame. In this embodiment, the excitation signal, being not encoded at the transmitter, is derived at the receiver from the received NB signal by using an LPC scheme, such as an LPC lattice structure. Therefore, this is another example wherein an upper-band portion of an original audio stream is being coded, i.e. the LPC coefficients and the gain, whereas a narrowband portion of the original audio stream is not coded. The combination of coded and uncoded portions of the audio stream is transmitted and then received in such a way as to decode the portions that require decoding.

In addition to saving bits during transmission, this method has another advantage: it does not need any explicit voiced/unvoiced decision and control as G.729 or any other vocoder does, because the excitation (LPC residue) derived at the receiver will automatically be periodic like when the received NB signal is voiced, and white-noise like when the signal is unvoiced. Thus, the encoding/decoding scheme according to an embodiment of the present invention for the upper-band is much simpler than a vocoder. As a result, the upper-band signal can be coded with no more than 18+5=23 bits per 80-sample frame, or 0.29 bit per NB data sample.

Figure 19:
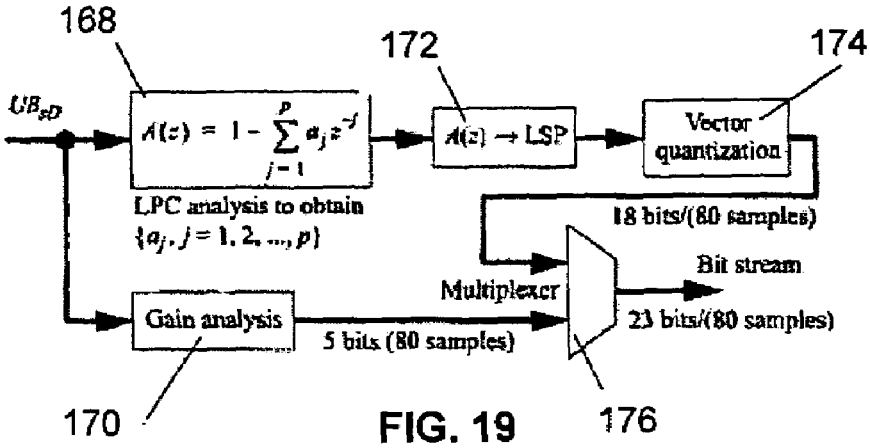
FIG. 19 illustrates a block diagram of an encoder for use with a coding-assisted bit manipulation scheme according to another embodiment of the present invention.
Figure 24:
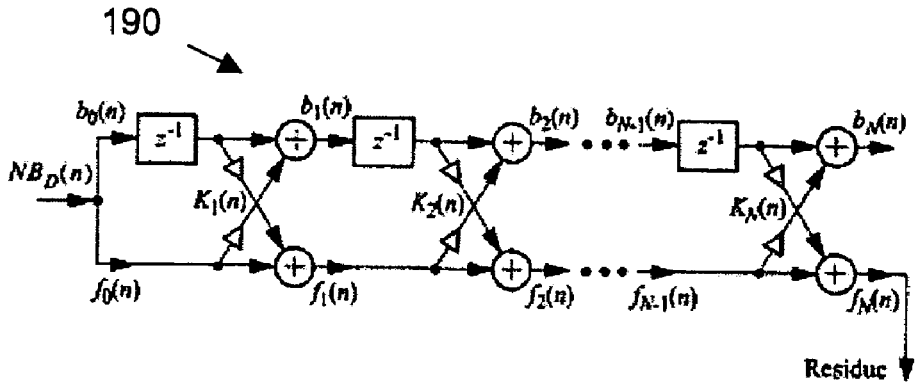
FIG. 24 illustrates an LPC structure for a receiver/decoder to be used in a coding-assisted bit manipulation scheme according to an embodiment of the present invention.
Figure 25:
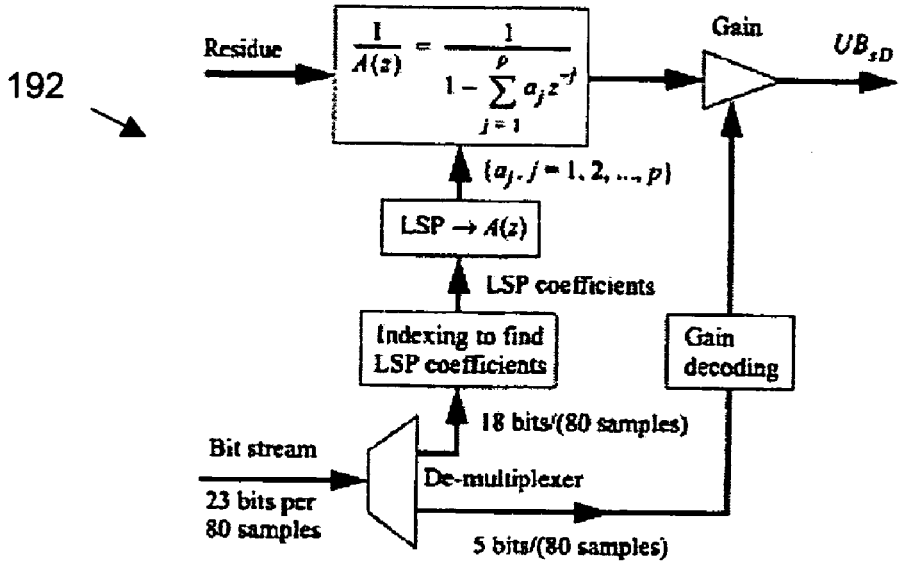
FIG. 25 illustrates a block diagram of a decoder for use with a coding-assisted bit manipulation scheme according to another embodiment of the present invention.

The block diagram for encoding is shown in FIG. 19, and that for decoding will be shown in FIG. 24 and FIG. 25.

Although in FIG. 19, use of part of the G.729 recommendation is assumed, this is not necessarily the case; one can use another LPC scheme that performs the same tasks as shown in the figure. An audio stream is analyzed in LPC analyzer 168 and gain analyzer 170 in order to obtain the LPC and gain coefficients that are to be coded prior to transmission. In FIG. 19, p (p=10 in this example) LPC coefficients are converted to linear spectral pair (LSP) coefficients in block 172 for better immunity to quantization noise. The LSP coefficients are then quantized by vector quantizer 174 using a vector quantization scheme in order to reduce the bit rate. The gain analyzer 170 calculates the energy of the signal in the frame and code the energy value into 5 bits. The outputs of the gain analyzer 170 and the vector quantizer 174 are multiplexed in multiplexer 176, which yields a bit stream representing the upper-band signal.

Figure 20:
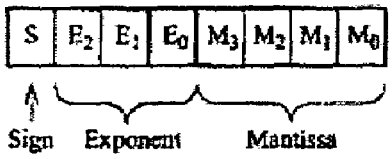
PRIOR ART FIG. 20
FIG. 20 illustrates an 8-bit companded data format.

5. The next step is to embed the bits representing the encoded upper-band signal into the 80 samples of the NB data in the frame, with the data format being 8-bit companded. An 8-bit companded data format, μ-law or A-law, consists of 1 sign bit (S), 3 exponent bits (E 2, E 1, and E 0), and 4 mantissa bits (M 3, M 2, M 1, and M 0), as shown in FIG. 20.

Employing the coding embodiment that uses the upper-band portion of ITU-T G.722 voice codec. In this example, it is sufficient to replace $M_0$, the LSB of the mantissa part of each 8-bit data, with one encoded bit. As discussed earlier, this may significantly bring up the noise floor.

Figure 21:
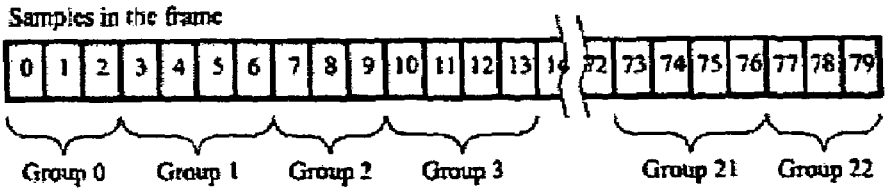
FIG. 21 illustrates a grouping of a narrowband data frame according to an embodiment of the present invention.

Employing the coding embodiment that codes LPC coefficients and gain, the embedding is done differently. First, the frame of 80 samples is partitioned into 23 groups. Groups 0, 2, 4, . . . , 22 contain 3 data samples each, and groups 1, 3, 5, . . . , 21 have 4 samples each, as shown in FIG. 21.

The 23 bits are to be embedded into the 23 groups, respectively. To do so, the 3 or 4 8-bit samples in each group are algebraically added together—regardless of the physical meaning of the sum. The LSB, i.e., $M_0$, of the mantissa of the group member with the smallest magnitude may be modified depending on the value of the bit to be embedded and whether the sum is even or odd. This is summarized in Table 6.

TABLE 6

| Value of bit to be embedded | Nature of sum of 8-bit group members | How $M_0$ of group member with smallest magnitude is modified |
|---|---|---|
| 0 | Even | No modification |
| | Odd | Flip (1 ↔ 0) |
| 1 | Even | Flip (1 ↔ 0) |
| | Odd | No modification |

As a result of this operation, the sum of the group members will be even if the embedded bit is 0, and odd otherwise. It can be seen from Table 6 that, one LSB in each group has a 50 percent chance of being modified and, once it is, the data sample it belongs to has an equal probability of being increased or decreased. Therefore, the expectation value of the modification to the group is $$E[\text{mod}] = \frac{0+0+0.25\cdot 1+0.25\cdot(-1)}{(3 \text{ or } 4)} = 0 \tag{30}$$

Furthermore, the mean square error (MSE) of the modification is $$E[\text{mod}^2] = \frac{0+0+0.25\cdot 1^2+0.25\cdot(-1)^2}{(3 \text{ or } 4)} \approx (0.167 \text{ or } 0.125) \approx (0.41^2 \text{ or } 0.35^2) \tag{31}$$

Equation (30) means that the modification is unbiased; it does not distort the signal but to add noise, whose MSE is, according to Eq. (31), equivalent to that of a white noise with a magnitude less than half a bit.

6. During frames where there is no audio activity, a unique 23-bit pattern can be sent. These frames will help the receiver acquire and keep in synchronization with the transmitter.

7. During transmission. The signal sequence is sent through a digital audio channel, such as that with a digital PBX or VoIP, to the remote receiver.

At a conventional digital receiver

8. A conventional digital receiver, being NB, treats the received signal as an ordinary digital audio signal, convert it to analog, and send it to its electro-acoustic transducer such as a handset receiver or a handsfree loudspeaker. The modifications made to certain LSBs (M 0) by Step "5." above, especially in the case of "coding LPC coefficients and gain," have a minor impact on the perceptual audio quality and therefore will not be very audible to average listeners.

At a receiver equipped with the "Coding assisted audio bandwidth extension using BM" scheme (FIG. 22)

9. Frame synchronization. The frame boundaries are determined by examining the synchronization word repeatedly transmitted during frames with no voice activity, as discussed in Step "6." above.

10. Bit stream extraction (178 in FIG. 22) This step is the inverse of Step "5." above. In the case of the use of upper-band portion of ITU-T G.722 voice codec, we can obtain 80 bits from the 80 received samples by simply reading their LSBs of the mantissa part. In the case of coding LPC coefficients and gain, first an 80-sample frame of data is partitioned into 23 groups as in FIG. 21. Next, the sum of the 8-bit samples in each group is found. Last, the value of the bit embedded in each group is determined as per Table 7 below.

TABLE 7

| Nature of sum of 8-bit group members | Value of bit embedded |
|---|---|
| Even | 0 |
| Odd | 1 |

Figure 23:
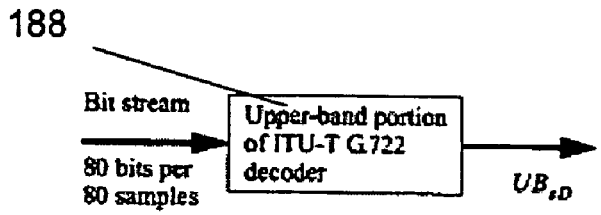
FIG. 23 illustrates a block diagram of a decoder for use with a coding-assisted bit manipulation scheme according to an embodiment of the present invention.

11. Audio or voice decoding (180). Now steps are taken to decode to the extracted bit stream. In the case of the use of upper-band portion of ITU-T G.722 voice codec, the decoding is done by using decoder 188, such as an ITU-T G.722 upper-band decoder, as shown in FIG. 23. In the case of the use of the coding LPC coefficients and gain, the idea behind the decoding in this case is to derive an excitation from the received NB signal and use it to excite an all-pole speech production model whose parameters are obtained by decoding the bits received. The excitation is actually the residue of an LPC analysis on the received NB signal. For fast convergence in order to obtain a well whitened residue, an efficient adaptive lattice LPC filter is used. FIG. 24 illustrates the topology of this filter 190.

The adaptation algorithm is given in Eq. (32).

Initalization $$m = 1, 2, \ldots, N \tag{32}$$

$$g_{m-1}(-1) = 2\sigma_0^2/\alpha$$

$$b_m(-1) = 0$$

-continued $$K_m(-1) = 0$$

$$n = 0, 1, 2, \ldots$$

$$f_0(n) = b_0(n) = N\hat{B}_D(n)$$

$$m = 1, 2, \ldots, N$$

$$f_m(n) = f_{m-1}(n) + K_m(n)b_{m-1}(n-1)$$

$$b_m(n) = K_m(n)f_{m-1}(n) + b_{m-1}(n-1)$$

$$g_{m-1}(n) = (1-\alpha)\cdot g_{m-1}(n-1) + f_{m-1}^2(n) + b_{m-1}^2(n-1)$$

$$K_m(n+1) = K_m(n) - \frac{f_m(n)b_{m-1}(n-1) + b_m(n)f_{m-1}(n)}{g_{m-1}(n)}$$

In the above, $\{K_m(n), m=1, 2, \ldots, N\}$ are the so-called reflection coefficients, N is the order of the system, a is the normalized step size (we use N=10 and $\alpha$=0.15 in our prototype), and $\sigma_0$ is an estimate of the mean square value of the filter input.

Next, the LPC residue obtained above is used to excite an all-pole speech production model and the gain is properly adjusted, as in decoder 192 shown in FIG. 25. In this example, part of the ITU-T G.729 decoder is used to decode the all-pole model coefficients $\{a_j, j=1, 2, \ldots, p\}$ and to implement the all-pole implementation. However, this is not necessarily the case; another scheme that decodes the coefficients and implements the model can also be used without deviating from the concept behind the invention.

12. Interpolation for $\hat{N}B$ and $\hat{U}B_s$ (182). At this point, both $\hat{N}B_D$ and $\hat{A}B_{sD}$ are sampled at 8000 Hz and they should be up-sampled to 16000 Hz, the sampling rate of the final output. By inserting a 0 between every pair of adjacent samples, i.e.

$$\hat{N}B^l(2n) = \hat{N}B_D(n), \quad \hat{N}B^n(2n+1) = 0 \tag{33}$$

$$\hat{U}B_s^l(2n) = \hat{U}B_{sD}(n), \quad \hat{U}B_s^l(2n+1) = 0$$

$$n = 0, 1, \ldots, \frac{N}{2} - 1$$

and low-pass filtering the two resultant sequences, we get $\hat{N}B$ and $\hat{U}B_s$, respectively. Characteristics of the low-pass filtering here are the same as that shown in Table 5. As a result of this low-pass filtering, $\hat{N}B$ and $\hat{U}B_s$ contain few components beyond 3900 Hz.

13. Frequency up-shift (184). The purpose of this stage is to move the decoded frequency-shifted upper-band signal, now occupying the NB, to its destination frequency band, i.e., the upper-band. The amount of frequency up-shift, being $F_{shift}$=3290 Hz in our exercise, must be the same as that of the frequency down-shift performed in the transmitter. In the k-th frame, the frequency up-shift operation consists of $$UB^l(n) = \hat{U}B_s(n)\cdot\cos\left[\frac{2\pi F_{shift}}{16000}(kN+n)\right], \forall n \in [0, N-1] \tag{34}$$

and the intermediate value $UB^l(n)$ in Eq. (34) being high-pass filtered to get rid of unwanted images. The output of this high-pass filter is $\hat{U}B$, in FIG. 22. The high-pass filter is characterized as the high-pass filter in Table 4. As a result of this high-pass filtering, contains few components below 3290 Hz.

14. Summation to form output (186). In this last stage, the up-sampled received NB signal $\hat{N}B$ and the restored upper-band signal $\hat{U}B$, which has been up-sampled and frequency up-shifted, are added to form an audio signal with an extended bandwidth.

With respect to the earlier discussion regarding implementations of the bandwidth extension application, examples have been described in relation to including information from both the lower band and the upper band in a composite audio signal, for subsequent reception and decoding by an enhanced receiver. This is preferably implemented in relation to a continuous waveform, or analog audio signal. However, bandwidth extension can alternatively be implemented, for example, in terms of only including lower band information for a continuous waveform, or only including upper band information in an audio stream in the digital domain, or any other reasonable variation.

With respect to practical hardware implementation, embodiments of the present invention can be preferably implemented as an improved acoustic microphone/receiver for use in a telephone set, to allow it to handle wideband signals. Alternatively, it could be implemented on any piece of hardware having a DSP with spare processing capacity, either integral to an existing piece of hardware, or as its own separate adjunct box. Hardware implementations in an enhanced transceiver can be achieved by storing code and/or instructions that, when executed, perform steps in methods according to embodiments of the present invention, as described earlier.

In summary, this invention relates to the manipulation of audio components substantially below the perceptual threshold without degrading the subjective quality of an audio stream. Spaces created by removing components substantially below, and preferably entirely below, the perceptual threshold can be filled with components bearing additional payload without degrading the subjective quality of the sound as long as the added components are substantially below the perceptual threshold. Also, certain parameters, e.g., the magnitudes of audio components, can be perturbed without degrading the subjective quality of the sound as long as the perturbation is substantially below the perceptual threshold. This is true even if these audio components themselves are significantly above the perceptual threshold in level.

Although frequency domain examples have been predominantly used for illustration in this document, "perceptual threshold" here generally refers to a threshold in either the time or a transform domain, such as the frequency domain, and signal components below this threshold are not perceptible to most listeners. The characteristics of an audio stream are dynamic. Thus when necessary, the estimate of the above-mentioned perceptual threshold should be updated constantly. In general, certain auxiliary information is to be encoded along with the added components, which tells the receiver how to correctly restore the additional payload in the added components.

The ways of encoding the auxiliary information may include, but not limited to, certain alterations to the added components and/or the remaining components, which were intact during the removal operation described above. These alterations should be done under the perceptual threshold and may include, but are not limited to, amplitude modulation, phase modulation, spread spectrum modulation, and echo manipulation, of the corresponding components.

For the audio bandwidth extension application, audio or voice codecs can be used to encode the out-of-NB signal components into digital bits, which can then be embedded into and transmitted with the NB signal. At the receiver, these bits can be retrieved from the received NB signal, via an operation inverse to the embedding process performed in the transmitter, and the out-of-NB signal components can be decoded from those bits. In a digital representation of an audio signal, certain digital bits can be modified to carry additional payload with no or minimum perceptual degradation to the audio. This is true not only with high-resolution data formats such as the 16-bit linear, but also with low-resolution ones, e.g., 8-bit companded formats like μ-law and A-law. In the audio bandwidth extension application as discussed above, these bits can be replaced by those representing the out-of-NB signal components.

In other possible implementations of the audio bandwidth extension application as discussed above, digital bits representing the out-of-NB signal components don't necessarily have to replace certain bits in the NB digital audio signal. They can, instead, be embedded into the analog or digital NB signal by the CR or MP scheme discussed in this document, or by other means such as changing magnitudes of certain signal components in the discrete cosine transform (DCT) or modified discrete cosine transform (MDCT) domain. Although the use of DCT or MDCT hasn't been discussed herein, a scheme using DCT or MDCT would be similar to either a CR or MP scheme discussed in this document, except that the DCT or MDCT is used instead of the discrete Fourier transform (DFT). The MDCT is also sometimes referred to as the modulated lapped transform (MLT).

In a system as outlined above, there is a potential for the encoding and decoding of the out-of-NB signal to be simplified from their original schemes. This is because certain information that resides in the NB signal, which is readily available at the receiver, can be used to assist the decoding process, so that the encoding mechanism does not need to transmit as much information as it has to if the NB signal is totally absent at the receiver. In each of the specific examples discussed herein, only a small sub-set of the corresponding original codec scheme is used. In particular, in the "coding LPC coefficients and gain" implementation scheme discussed, an adaptive lattice LPC scheme can be used to derive from the received NB signal an excitation, which then serves as the input to an all-pole model to generate the upper-band signal. If this excitation is encoded at the transmitter and decoded at the receiver as done by conventional codecs such as the ITU-T G.729, it would cost much more channel capacity. To implement the concept described above, the audio signal can be processed on a frame-by-frame basis. There may or may not be a data overlap between each adjacent frame pair.

Embodiments of the present invention can be implemented as a computer-readable program product, or part of a computer-readable program product, for use in an apparatus for transmitting and/or receiving an audio stream, and/or an add-on device for use with such apparatus. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or electrical communications lines) or a medium implemented with wireless techniques (e.g., microwave, infrared or other transmission techniques). The series of computer instructions embodies all or part of the functionality previously described herein, in particular in relation to the method steps. Those skilled in the art will appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that, in the context of VoIP applications, such a computer-readable program product may be distributed as a removable medium with accompanying printed or electronic documentation (e.g., shrink-wrapped software), preloaded with a computer system (e.g., on system ROM or fixed disk), or distributed from a server over the network (e.g., the Internet or World Wide Web). Of course, some embodiments of the invention may be implemented as a combination of software (e.g., a computer-readable program product), firmware, and hardware. Still other embodiments of the invention may be implemented as entirely hardware, entirely firmware, or entirely software (e.g., a computer-readable program product).

Embodiments of the invention may be implemented in any conventional computer programming language. For example, preferred embodiments may be implemented in a procedural programming language (e.g. "C") or an object oriented language (e.g. "C++"). Alternative embodiments of the invention may be implemented as pre-programmed hardware elements, other related components, or as a combination of hardware and software components.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A method of transmitting an audio stream, comprising:

estimating a perceptual mask for the audio stream, the perceptual mask being based on a human auditory system perceptual threshold;

dynamically allocating a hidden sub-channel substantially below the estimated perceptual mask for the audio stream, the dynamic allocation being based on characteristics of the audio stream; and generating a composite audio stream, the composite audio stream including uncoded narrowband components of the audio stream for which the perceptual mask was estimated, the composite audio stream further including additional payload in the hidden sub-channel, the uncoded narrowband components of the composite audio stream being audible to a human ear at a receiver without decoding; and transmitting the composite audio stream.

2. The method of claim 1 wherein the composite audio stream is an analog signal.

3. The method of claim 1 further comprising the step of partitioning the audio stream into audio segments.

4. The method of claim 3 wherein the step of partitioning is performed prior to the steps of estimating, dynamically allocating, generating and transmitting, and wherein the steps of estimating, dynamically allocating, generating and transmitting are performed in relation to each audio segment.

5. The method of claim 1 wherein the step of transmitting additional payload comprises:

removing an audio segment component from within the hidden sub-channel; and adding the additional payload in place of the removed audio segment component.

6. The method of claim 1 wherein the step of transmitting the additional payload comprises:

adding a noise component within the hidden sub-channel, the noise component bearing the additional payload.

7. The method of claim 6, wherein the noise component is introduced as a perturbation to an audio segment component in the frequency domain, further comprising the steps of:

transforming the audio segment component from the time domain to the frequency domain;

calculating a magnitude of each frequency component of the audio segment component;

determining a magnitude and sign for each frequency component perturbation;

perturbing each frequency component by the determined frequency component perturbation;

quantizing each perturbed frequency component; and, transforming the audio segment component back to the time domain from the frequency domain.

8. The method of claim 1 wherein the audio stream is a digital audio stream, and wherein the step of transmitting the additional payload comprises:

modifying certain bits in the digital audio stream to carry the additional payload.

9. The method of claim 1 wherein the additional payload includes data for providing a concurrent service.

10. The method of claim 9 wherein the concurrent service is selected from the group consisting of: instant calling line identification; non-interruption call waiting; concurrent text messaging; and display-based interactive services.

11. The method of claim 1 further comprising:

encoding only an upper-band portion of the audio stream; and generating the additional payload based on the encoded upper-band portion of the audio stream.

12. An apparatus for transmitting an audio stream, comprising:

a perceptual mask estimator for estimating a perceptual mask for the audio stream, the perceptual mask being based on a human auditory system perceptual threshold;

a hidden sub-channel dynamic allocator for dynamically allocating a hidden sub-channel substantially below the estimated perceptual mask for the audio stream, the dynamic allocation being based on characteristics of the audio stream;

a composite audio stream generator for generating a composite audio stream, the composite audio stream including uncoded narrowband components of the audio stream for which the perceptual mask was estimated, the composite audio stream further including additional payload in the hidden sub-channel, the uncoded narrowband components of the composite audio stream being audible to a human ear at a receiver without decoding; and a transceiver for receiving the audio stream and for transmitting the composite audio stream.

13. The apparatus of claim 12 further comprising:

a coder for coding only an upper-band portion of the audio stream, wherein the composite audio stream generator generates the additional payload based on the encoded upper-band portion of the audio stream.

14. An apparatus for receiving a composite audio stream having additional payload in a hidden sub-channel of the composite audio stream, comprising:

an extractor for extracting the additional payload from the composite audio stream, the composite audio stream further including uncoded narrowband components that are audible to a human ear at a receiver without decoding;

an audio stream reconstructor for restoring the additional payload to form an enhanced analog audio stream in conjunction with the uncoded narrowband components; and a transceiver for receiving the composite audio stream and for transmitting the enhanced audio stream for listening by a user.

15. The apparatus of claim 14 wherein the extractor further comprises means for estimating a perceptual mask for the audio stream, the perceptual mask being based on a human auditory system perceptual threshold.

16. The apparatus of claim 14 wherein the extractor further comprises means for determining the location of the additional payload.

17. The apparatus of claim 14 wherein the audio stream reconstructor comprises: an excitation deriver for deriving an excitation of the audio stream based on a received narrowband audio stream.

18. The apparatus of claim 17 wherein the excitation is derived by using an LPC scheme.

19. A method of communicating an audio stream, comprising:

coding only an upper-band portion of the audio stream;

transmitting the coded upper-band portion and an uncoded narrowband portion of the audio stream, the uncoded narrowband portion being audible to a human ear at a receiver without decoding;

decoding the coded upper-band portion of the audio stream; and reconstructing the audio stream based on the decoded upper-band portion and the uncoded narrowband portion of the audio stream.

20. The method of claim 19 wherein the step of coding the upper-band portion of the audio stream comprises:

determining linear predictive coding (LPC) coefficients of the audio stream, the LPC coefficients representing a spectral envelope of the audio stream; and determining gain coefficients of the audio stream.

21. The method of claim 19 wherein the upper-band portion of the audio stream is coded and decoded by one of: an upper-band portion of an ITU G.722 codec, and an LPC coefficient portion of an ITU G.729 codec.

22. An apparatus for communicating an audio stream, comprising:

a coder for coding only an upper-band portion of the audio stream;

a transmitter for transmitting the coded upper-band portion and an uncoded narrowband portion of the audio stream, the uncoded narrowband portion being audible to a human ear at a receiver without decoding;

a decoder for decoding the coded upper-band portion of the audio stream; and a reconstructor for reconstructing the audio stream based on the decoded upper-band portion and the uncoded narrowband portion of the audio stream.

* * * * *